US008461811B2

(12) United States Patent
Porter et al.

(10) Patent No.: US 8,461,811 B2
(45) **Date of Patent: *Jun. 11, 2013**

(54) POWER CAPACITOR ALTERNATIVE SWITCH CIRCUITRY SYSTEM FOR ENHANCED CAPACITOR LIFE

(75) Inventors: Robert M. Porter, Wellington, CO (US); Anatoli Ledenev, Fort Collins, CO (US)

(73) Assignee: AMPT, LLC, Fort Collins, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/078,492

(22) Filed: Apr. 1, 2011

(65) Prior Publication Data

US 2011/0181251 A1 Jul. 28, 2011

Related U.S. Application Data

(63) Continuation of application No. 12/738,068, filed as application No. PCT/US2008/080794 on Oct. 22, 2008, now Pat. No. 7,919,953.

(60) Provisional application No. 60/982,053, filed on Oct. 23, 2007, provisional application No. 60/986,979, filed on Nov. 9, 2007.

(51) Int. Cl.
*G05F 1/46* (2006.01)

(52) U.S. Cl.
USPC ..... 323/222; 323/906; 363/89

(58) Field of Classification Search
USPC ..... 323/222, 282, 351, 906; 363/89
See application file for complete search history.

(56) References Cited

U.S. PATENT DOCUMENTS

| | | | |
|---|---|---|---|
| 3,900,943 | A | 8/1975 | Sirti et al. |
| 4,127,797 | A | 11/1978 | Perper |
| 4,168,124 | A | 9/1979 | Pizzi |
| 4,218,139 | A | 8/1980 | Sheffield |
| 4,222,665 | A | 9/1980 | Tacjozawa et al. |

(Continued)

FOREIGN PATENT DOCUMENTS

| | | | |
|---|---|---|---|
| EP | 0677749 | A3 | 1/1996 |
| EP | 0677749 | A2 | 10/1996 |

(Continued)

OTHER PUBLICATIONS http://www.solarsentry.com; Protecting Your Solar Investment, 2005, Solar Sentry Corp.

(Continued)

*Primary Examiner* — Jeffrey Sterrett
(74) *Attorney, Agent, or Firm* — Santangelo Law Offices, P.C.

(57) ABSTRACT

Reliability enhanced systems are shown where an short-lived electrolytic capacitor can be replaced by a much smaller, perhaps film type, longer-lived capacitor to be implemented in circuits for power factor correction, solar power conversion, or otherwise to achieve DC voltage smoothing with circuitry that has solar photovoltaic source (1) a DC photovoltaic input (2) internal to a device (3) and uses an enhanced DC-DC power converter (4) to provide a smoothed DC output (6) with capacitor substitution circuitry (14) that may include interim signal circuitry (28) that creates a large voltage variation for a replaced capacitor (16). Switchmode designs may include first and second switch elements (17) and (18) and an alternative path controller (21) that operates a boost controller (22) and a buck controller (23) perhaps with a switch duty cycle controller (32).

31 Claims, 14 Drawing Sheets

U.S. PATENT DOCUMENTS 4,249,958 A 2/1981 Baudin et al.
4,274,044 A 6/1981 Barre
4,341,607 A 7/1982 Tison
4,375,662 A 3/1983 Baker
4,390,940 A 6/1983 Corbefin et al.
4,395,675 A 7/1983 Toumani
4,404,472 A 9/1983 Steigerwald
4,409,537 A 10/1983 Harris
4,445,030 A 4/1984 Carlson
4,445,049 A 4/1984 Steigerwald
4,513,167 A 4/1985 Brandstetter
4,528,503 A 7/1985 Cole
4,580,090 A 4/1986 Bailey et al.
4,581,716 A 4/1986 Kamiya
4,619,863 A 10/1986 Taylor
4,626,983 A 12/1986 Harada et al.
4,649,334 A 3/1987 Nakajima
4,725,740 A 2/1988 Nakata
4,749,982 A 6/1988 Rikuna et al.
4,794,909 A 1/1989 Elden
4,873,480 A 10/1989 Lafferty
4,896,034 A 1/1990 Kiriseko
4,899,269 A 2/1990 Rouzies
4,922,396 A 5/1990 Niggemeyer
5,027,051 A 6/1991 Lafferty
5,028,861 A 7/1991 Pace et al.
5,179,508 A 1/1993 Lange et al.
5,270,636 A 12/1993 Lafferty
5,401,561 A 3/1995 Fisun et al.
5,402,060 A 3/1995 Erisman
5,493,155 A 2/1996 Okamoto et al.
5,493,204 A 2/1996 Caldwell
5,503,260 A 4/1996 Riley
5,646,502 A 7/1997 Johnson
5,648,731 A 7/1997 Decker et al.
5,659,465 A 8/1997 Flack et al.
5,669,987 A 9/1997 Takehara et al.
5,689,242 A 11/1997 Sims et al.
5,741,370 A 4/1998 Hanoka
5,747,967 A 5/1998 Muljadi et al.
5,782,994 A 7/1998 Mori et al.
5,801,519 A 9/1998 Midya et al.
5,896,281 A 4/1999 Bingley
5,898,585 A 4/1999 Sirichote et al.
5,923,100 A 7/1999 Lukens et al.
5,932,994 A 8/1999 Jo et al.
6,046,401 A 4/2000 McCabe
6,081,104 A 6/2000 Kern
6,124,769 A 9/2000 Igarashi et al.
6,162,986 A 12/2000 Shiotsuka
6,180,868 B1 1/2001 Yoshino et al.
6,181,590 B1 1/2001 Yamane et al.
6,191,501 B1 2/2001 Bos
6,218,605 B1 4/2001 Daily et al.
6,218,820 B1 4/2001 D'Arrigo et al.
6,219,623 B1 4/2001 Wills
6,262,558 B1 7/2001 Weinberg
6,278,052 B1 8/2001 Takehara et al.
6,281,485 B1 8/2001 Siri
6,282,104 B1 8/2001 Kern
6,314,007 B2 11/2001 Johnson, Jr. et al.
6,331,670 B2 12/2001 Takehara et al.
6,351,400 B1 2/2002 Lumsden
6,369,462 B1 4/2002 Siri
6,433,522 B1 8/2002 Siri
6,433,992 B2 8/2002 Nakagawa et al.
6,441,896 B1 8/2002 Field
6,448,489 B2 9/2002 Kimura et al.
6,493,246 B2 12/2002 Suzui et al.
6,515,215 B1 2/2003 Mimura
6,545,211 B1 4/2003 Mimura
6,545,868 B1 4/2003 Kledzik et al.
6,593,521 B2 7/2003 Kobayashi
6,624,350 B2 9/2003 Nixon et al.
6,670,721 B2 12/2003 Lof et al.
6,686,533 B2 2/2004 Raum et al.
6,686,727 B2 2/2004 Ledenev et al.
6,703,555 B2 3/2004 Takabayashi et al.
6,750,391 B2 6/2004 Bower et al.
6,791,024 B2 9/2004 Toyomura
6,804,127 B2 10/2004 Zhou
6,889,122 B2 5/2005 Perez
6,914,418 B2 7/2005 Sung
6,914,420 B2 7/2005 Crocker
6,920,055 B1 7/2005 Zeng et al.
6,952,355 B2 10/2005 Riggio et al.
6,958,922 B2 10/2005 Kazem
6,984,965 B2 1/2006 Vinciarelli
6,984,970 B2 1/2006 Capel
7,019,988 B2 3/2006 Fung et al.
7,046,531 B2 5/2006 Zocchi et al.
7,068,017 B2 6/2006 Willner et al.
7,072,194 B2 7/2006 Nayar et al.
7,091,707 B2 8/2006 Cutler
7,092,265 B2 8/2006 Kernahan
7,158,395 B2 1/2007 Deng et al.
7,193,872 B2 3/2007 Siri
7,227,278 B2 6/2007 Realmuto et al.
7,248,946 B2 7/2007 Bashaw et al.
7,274,975 B2 9/2007 Miller
7,333,916 B2 2/2008 Warfield et al.
7,339,287 B2 3/2008 Jepsen et al.
7,365,661 B2 4/2008 Thomas
7,471,073 B2 12/2008 Rettenwort et al.
7,479,774 B2 1/2009 Wai et al.
7,514,900 B2 4/2009 Sander et al.
7,596,008 B2 9/2009 Iwata et al.
D602,432 S 10/2009 Moussa
7,602,080 B1 10/2009 Hadar et al.
7,605,498 B2 10/2009 Ledenev et al.
7,619,200 B1 11/2009 Seymour et al.
7,619,323 B2 11/2009 Tan et al.
7,663,342 B2 2/2010 Kimball et al.
7,719,140 B2 5/2010 Ledenev et al.
7,768,155 B2 8/2010 Fornage
7,786,716 B2 8/2010 Simburger et al.
7,807,919 B2 10/2010 Powell
7,834,580 B2 11/2010 Haines
7,843,085 B2 11/2010 Ledenev et al.
7,919,953 B2 * 4/2011 Porter et al. ..... 323/222
7,948,221 B2 5/2011 Watanabe et al.
7,962,249 B1 6/2011 Zhang et al.
8,004,116 B2 8/2011 Ledenev et al.
8,093,756 B2 1/2012 Porter et al.
8,106,765 B1 1/2012 Ackerson et al.
8,242,634 B2 8/2012 Schatz et al.
8,304,932 B2 11/2012 Ledenev et al.
2001/0007522 A1 7/2001 Nakagawa et al.
2001/0032664 A1 10/2001 Takehara et al.
2002/0038200 A1 3/2002 Shimizu et al.
2002/0195136 A1 12/2002 Takabayashi et al.
2003/0062078 A1 4/2003 Mimura
2003/0075211 A1 4/2003 Makita et al.
2003/0117822 A1 6/2003 Stamenic et al.
2004/0095020 A1 5/2004 Kernahan et al.
2004/0100149 A1 5/2004 Lai
2004/0135560 A1 7/2004 Kernahan et al.
2004/0159102 A1 8/2004 Toyomura et al.
2004/0164557 A1 8/2004 West
2004/0207366 A1 10/2004 Sung
2004/0211456 A1 10/2004 Brown et al.
2005/0002214 A1 1/2005 Deng et al.
2005/0068012 A1 3/2005 Cutler
2005/0105224 A1 5/2005 Nishi
2005/0109386 A1 5/2005 Marshall
2005/0116475 A1 6/2005 Hibi et al.
2005/0121067 A1 6/2005 Toyomura
2005/0162018 A1 7/2005 Realmuto et al.
2005/0169018 A1 8/2005 Hatai et al.
2005/0254191 A1 11/2005 Bashaw et al.
2006/0017327 A1 1/2006 Siri et al.
2006/0103360 A9 5/2006 Cutler
2006/0162772 A1 7/2006 Presher et al.
2006/0171182 A1 8/2006 Siri et al.
2006/0174939 A1 8/2006 Matan
2007/0024257 A1 2/2007 Boldo
2007/0035975 A1 2/2007 Dickerson et al.

2007/0044837 A1 3/2007 Simburger et al.
2007/0069520 A1 3/2007 Schetters
2007/0111103 A1 5/2007 Konishiike et al.
2007/0119718 A1 5/2007 Gibson et al.
2007/0133241 A1 6/2007 Mumtaz et al.
2007/0159866 A1 7/2007 Siri
2007/0165347 A1 7/2007 Wendt et al.
2007/0171680 A1 7/2007 Perreault et al.
2007/0236187 A1 10/2007 Wai et al.
2008/0036440 A1 2/2008 Garmer
2008/0062724 A1 3/2008 Feng et al.
2008/0097655 A1 4/2008 Hadar et al.
2008/0101101 A1 5/2008 Iwata et al.
2008/0111517 A1 5/2008 Pfeifer et al.
2008/0123375 A1 5/2008 Beardsley
2008/0136367 A1 6/2008 Adest et al.
2008/0143188 A1 6/2008 Adest et al.
2008/0144294 A1 6/2008 Adest et al.
2008/0147335 A1 6/2008 Adest et al.
2008/0150366 A1 6/2008 Adest et al.
2008/0164766 A1 7/2008 Adest et al.
2008/0186004 A1 8/2008 Williams
2008/0236648 A1 10/2008 Klein et al.
2008/0238195 A1 10/2008 Shaver
2008/0247201 A1 10/2008 Perol
2008/0257397 A1 10/2008 Glaser et al.
2009/0039852 A1 2/2009 Fishelov et al.
2009/0078300 A1 3/2009 Ang et al.
2009/0114263 A1 5/2009 Powell et al.
2009/0120485 A1 5/2009 Kikinis
2009/0133736 A1 5/2009 Powell et al.
2009/0140715 A1 6/2009 Adest et al.
2009/0141522 A1 6/2009 Adest et al.
2009/0145480 A1 6/2009 Adest et al.
2009/0146505 A1 6/2009 Powell et al.
2009/0146667 A1 6/2009 Adest et al.
2009/0146671 A1 6/2009 Gazit
2009/0147554 A1 6/2009 Adest et al.
2009/0150005 A1 6/2009 Hadar et al.
2009/0160258 A1 6/2009 Allen et al.
2009/0206666 A1 8/2009 Sella et al.
2009/0207543 A1 8/2009 Boniface et al.
2009/0218887 A1 9/2009 Ledenev et al.
2009/0234692 A1 9/2009 Powell et al.
2009/0237042 A1 9/2009 Glovinski
2009/0237043 A1 9/2009 Glovinski
2009/0273241 A1 11/2009 Gazit et al.
2009/0283128 A1 11/2009 Zhang et al.
2009/0283129 A1 11/2009 Foss
2009/0284078 A1 11/2009 Zhang et al.
2009/0284232 A1 11/2009 Zhang et al.
2009/0284240 A1 11/2009 Zhang et al.
2009/0284998 A1 11/2009 Zhang et al.
2010/0001587 A1 1/2010 Casey et al.
2010/0026097 A1 2/2010 Avrutsky et al.
2010/0027297 A1 2/2010 Avrutsky et al.
2010/0038968 A1 2/2010 Ledenev et al.
2010/0078057 A1 4/2010 Karg et al.
2010/0085670 A1 4/2010 Palaniswami et al.
2010/0117858 A1 5/2010 Rozenboim
2010/0118985 A1 5/2010 Rozenboim
2010/0127570 A1 5/2010 Hadar et al.
2010/0127571 A1 5/2010 Hadar et al.
2010/0132758 A1 6/2010 Gilmore
2010/0139732 A1 6/2010 Hadar et al.
2010/0139734 A1 6/2010 Hadar et al.
2010/0139743 A1 6/2010 Hadar et al.
2010/0195361 A1 8/2010 Stem
2010/0229915 A1 9/2010 Ledenev et al,
2010/0246230 A1* 9/2010 Porter et al. ..... 363/131
2010/0253150 A1 10/2010 Porter et al.
2010/0308662 A1 12/2010 Schatz et al.
2011/0005567 A1 1/2011 VanderSluis et al.
2011/0067745 A1 3/2011 Ledenev et al.
2011/0095613 A1 4/2011 Huang et al.
2011/0115300 A1 5/2011 Chiang et al.
2011/0127841 A1 6/2011 Chiang et al.
2011/0160930 A1 6/2011 Batten et al.
2011/0175454 A1 7/2011 Williams et al.
2011/0181251 A1* 7/2011 Porter et al. ..... 323/222
2011/0193515 A1 8/2011 Wu et al.
2011/0210611 A1 9/2011 Ledenev et al.
2011/0316346 A1 12/2011 Porter et al.
2012/0175963 A1 7/2012 Adest et al.
2012/0223584 A1 9/2012 Ledenev et al.

FOREIGN PATENT DOCUMENTS

EP 0824273 A2 2/1998
EP 0964415 A1 12/1999
EP 0964457 A2 12/1999
EP 0964457 A3 12/1999
EP 00978884 A3 3/2000
EP 0780750 B1 3/2002
EP 1291997 3/2003
EP 1120895 A3 5/2004
FR 612859 11/1948
GB 310362 9/1929
GB 1231961 9/1969
GB 5050197 11/2005
GB 2415841 A 1/2006
GB 2419968 A 5/2006
GB 2421847 A 7/2006
GB 2434490 A 7/2007
JP 56042365 A2 4/1981
JP 60027964 A2 2/1985
JP 60148172 A2 8/1985
JP 62154121 A2 9/1987
JP 62-256156 11/1987
JP 05003678 A2 1/1993
JP 06035555 A2 2/1994
JP 06141261 A2 5/1994
JP 07026849 U2 1/1995
JP 07222436 A2 8/1995
JP 07-302130 11/1995
JP 08033347 A2 2/1996
JP 8046231 A 2/1996
JP 08066050 A2 3/1996
JP 08181343 A2 7/1996
JP 08204220 A2 8/1996
JP 09097918 A2 4/1997
JP 9148613 A2 6/1997
JP 2000020150 A2 1/2000
JP 2000-174307 6/2000
JP 20011086765 A 3/2001
JP 2002231578 A 8/2002
JP 2002231578 A2 8/2002
JP 2007104872 A 4/2007
JP 2007225625 A 6/2007
JP 27058845 A2 8/2007
JP 2007058843 A 8/2007
KR 1020050071689 A 7/2005
KR 1020060060825 A 7/2006
KR 1020070036528 A9 3/2007
KR 1020080092747 A 10/2008
WO 9003680 A1 4/1990
WO 02073785 A1 9/2002
WO 03036688 A2 4/2003
WO 2004100344 A2 11/2004
WO 2004100348 A1 11/2004
WO 2004107543 A1 12/2004
WO 2005027300 A1 3/2005
WO 2005036725 A1 4/2005
WO 2005076445 A1 8/2005
WO 2006005125 A1 1/2006
WO 2006013600 A2 2/2006
WO 2006013600 A3 2/2006
WO 2006048688 A1 5/2006
WO 2006048689 A2 5/2006
WO 2006048689 A3 5/2006
WO 2006071436 A2 7/2006
WO 2006078685 A2 7/2006
WO 2006117551 A2 11/2006
WO 2006137948 A2 12/2006
WO 2007007360 A2 1/2007
WO 2007080429 A2 7/2007
WO 2007142693 A3 12/2007
WO 2008125915 A2 10/2008
WO 2008125915 A3 10/2008

| | | | |
|---|---|---|---|
| WO | 2008132551 | A2 | 11/2008 |
| WO | 2008132551 | A3 | 11/2008 |
| WO | 2008132553 | A2 | 11/2008 |
| WO | 2008142480 | A2 | 11/2008 |
| WO | 2008142480 | A3 | 11/2008 |
| WO | 2008142480 | A4 | 11/2008 |
| WO | 2008069926 | A3 | 12/2008 |
| WO | 2009007782 | A2 | 1/2009 |
| WO | 2009007782 | A3 | 1/2009 |
| WO | 2009007782 | A4 | 1/2009 |
| WO | 2009051853 | A1 | 4/2009 |
| WO | 2009051854 | A1 | 4/2009 |
| WO | 2009051870 | A1 | 4/2009 |
| WO | 2009055474 | A1 | 4/2009 |
| WO | 2009059028 | A2 | 5/2009 |
| WO | 2009059028 | A3 | 5/2009 |
| WO | 2009064683 | A2 | 5/2009 |
| WO | 2009064683 | A3 | 5/2009 |
| WO | 2009072075 | A2 | 6/2009 |
| WO | 2009072075 | A3 | 6/2009 |
| WO | 2009072075 | A9 | 6/2009 |
| WO | 2009072076 | A2 | 6/2009 |
| WO | 2009072076 | A3 | 6/2009 |
| WO | 2009072077 | A1 | 6/2009 |
| WO | 2009073867 | A1 | 6/2009 |
| WO | 2009073868 | A1 | 6/2009 |
| WO | 2009075985 | A2 | 6/2009 |
| WO | 2009075985 | A3 | 6/2009 |
| WO | 2009114341 | A2 | 9/2009 |
| WO | 2009114341 | A3 | 9/2009 |
| WO | 2009118682 | A2 | 10/2009 |
| WO | 2009118682 | A3 | 10/2009 |
| WO | 2009118682 | A4 | 10/2009 |
| WO | 2009118683 | A2 | 10/2009 |
| WO | 2009118683 | A3 | 10/2009 |
| WO | 2009118683 | A4 | 10/2009 |
| WO | 2009136358 | A1 | 11/2009 |
| WO | 2009136358 | A4 | 11/2009 |
| WO | 2009140536 | A2 | 11/2009 |
| WO | 2009140536 | A3 | 11/2009 |
| WO | 2009140539 | A2 | 11/2009 |
| WO | 2009140539 | A3 | 11/2009 |
| WO | 2009140543 | A2 | 11/2009 |
| WO | 2009140543 | A3 | 11/2009 |
| WO | 2009140551 | A2 | 11/2009 |
| WO | 2009140551 | A3 | 11/2009 |
| WO | 2010002960 | A1 | 1/2010 |
| WO | 2010014116 | A1 | 2/2010 |
| WO | 2010062410 | A1 | 6/2010 |
| WO | 2010062662 | A2 | 6/2010 |
| WO | 2010062662 | A3 | 6/2010 |
| WO | 2010065043 | A1 | 6/2010 |
| WO | 2010120315 | A1 | 10/2010 |
| WO | 2011049985 | A1 | 4/2011 |
| WO | 2012100263 | A2 | 7/2012 |

OTHER PUBLICATIONS

Bower, et al. "Innovative PV Micro-Inverter Topology Eliminates Electrolytic Capacitors for Longer Lifetime," 1-4244-0016-3-06 IEEE p. 2038.

Solar Sentry Corp., Protecting Solar Investment "Solar Sentry's Competitive Advantage", 4 pages estimated as Oct. 2008.

Dallas Semiconductor; Battery I.D. chip from Dallas Semiconductor monitors and reports battery pack temperature, Bnet World Network, Jul. 10, 1995.

deHaan, S.W.H., et al; Test results of a 130W AC module, a modular solar AC power station, Photovoltaic Energy Conversion, 1994; Conference Record of the 24th IEEE Photovoltaic Specialists Conference Dec. 5-91994; 1994 IEEE First World Conference, vol. 1, pp. 925-928.

Gomez, M; "Consulting in the solar power age," IEEE-CNSV: Consultants' Network of Silicon Valley, Nov. 13, 2007.

Guo, G.Z.; "Design of a 400W, 1 Omega, Buck-boost Inverter for PV Applications," 32nd Annual Canadian Solar Energy Conference, Jun. 10, 2007.

Wang, Ucilia; Greentechmedia; "National semi casts solarmagic;" www.greentechmedia.com; Jul. 2, 2008.

Kroposki, H. Thomas and Witt, B & C; "Progress in Photovoltaic Components and Systems," National Renewable Energy Laboratory, May 1, 2000; NREL-CP-520-27460.

Hashimoto et al; "A Novel High Performance Utility Interactive Photovoltaic Inverter System," Department of Electrical Engineering, Tokyo Metropolitan University, 1-1 Miinami-Osawa, Hachioji, Tokyo, 192-0397, Japan; p. 2255, Aug. 6, 2002.

Hua, C et al; "Control of DC-DC Converters for Solar energy System with Maximum Power Tracking," Department of Electrical Engineering; National Yumin University of Science & Technology, Taiwan; vol. 2, Nov. 9-14, 1997; pp. 827-832.

Kern, G; "SunSine (TM)300: Manufacture of an AC Photovoltaic Module," Final Report, Phases I & II, Jul. 25, 1995-Jun. 30, 1998; National Renewable Energy Laboratory, Mar. 1999; NREL-SR-520-26085.

Kang, F et al; Photovoltaic Power Interface Circuit Incorporated with a Buck-boost Converter and a Full-bridge Inverter;' doi:10.1016-j.apenergy.2004.10.009.

Kretschmar, K et al; "An AC Converter with a Small DC Link Capacitor for a 15kW Permanent Magnet Synchronous Integral Motor,Power Electronics and Variable Speed Drive," 1998;7th International Conference; Conf. Publ. No. 456; Sep. 21-23, 1998; pp. 622-625.

Lim, Y.H. et al; "Simple Maximum Power Point Tracker for Photovoltaic Arrays," Electronics Letters May 25, 2000; vol. 36, No. 11.

Linear Technology Specification Sheet, LTM4607, estimated as Nov. 14, 2007.

Matsuo, H et al; Novel Solar Cell Power Supply System using the Multiple-input DC-DC Converter;' Telecommunications Energy Conference, 1998; INTELEC 20th International, pp. 797-8022.

solar-electric.com; Northern Arizona Wind & Sun, All About MPPT Solar Charge Controllers; Nov. 5, 2007.

Oldenkamp, H. et al; AC Modules: Past, Present and Future, Workshop Installing the Solar Solution; pp. 22-23; Jan. 1998; Hatfield, UK.

Rodriguez, C; "Analytic Solution to the Photovoltaic Maximum Power Point Problem;" IEEE Transactions of Power Electronics, vol. 54, No. 9, Sep. 2007.

De Doncker, R. W.; "Power Converter for PV-Systems," Institute for Power Electrical Drives, RWTH Aachen Univ. Feb. 6, 2006.

Roman, E et al; "Intelligent PV Module for Grid-Connected PV Systems;" IEEE Transactions of Power Electronics, vol. 53, No. 4, Aug. 2006.

Russell, M.C. et al; "The Massachusetts Electric Solar Project: A Pilot Project to Commercialize Residential PC Systems," Photovoltaic Specialists Conference 2000; Conference Record of the 28th IEEE; pp. 1583-1586.

SatCon Power Systems, PowerGate Photovoltaic 50kW Power Converter System; Spec Sheet; Jun. 2004.

Schekulin, Dirk et al; "Module-integratable Inverters in the Power-Range of 100-400 Watts," 13th European Photovoltaic Solar Energy Conference, Oct. 23-27, 1995; Nice, France; p. 1893-1896.

Shimizu, et al; "Generation Control Circuit for Photovoltaic Modules," IEEE Transactions on Power Electronics; vol. 16, No. 3, May 2001.

Takahashi, I. et al; "Development of a Long-life Three-phase Flywheel UPS Using an Electrolytic Capacitorless Converter-inverter," 1999 Scripta Technica, Electr. Eng. Jpn, 127(3); 25-32.

Walker, G.R. et al; "Cascaded DC-DC Converter Connection of Photovoltaic Modules," IEEE Transactions of Power Electronics, vol. 19, No. 4, Jul. 2004.

Walker, G.R. et al; "PV String Per-Module Power Point Enabling Converters," School of Information Technology and Electrical Engineering; The University of Queensland, presented at the Australasian Universities Power Engineering Conference, Sep. 28-Oct. 1, 2003 in Christchurch; AUPEC2003.

Cambridge Consultants, Interface Issue 43, Autumn 2007.

U.S. Appl. No. 60/980,157, filed Oct. 15, 2007.

U.S. Appl. No. 60/982,053, filed Oct. 23, 2007.

U.S. Appl. No. 60/986,979, filed Nov. 15, 2007.

U.S. Appl. No. 60/868,851, filed Dec. 6, 2006.

U.S. Appl. No. 60/868,893, filed Dec. 6, 2006.

U.S. Appl. No. 60/868,962, filed Dec. 7, 2006.
U.S. Appl. No. 60/908,095, filed Mar. 26, 2007.
U.S. Appl. No. 60/916,815, filed May 9, 2007.
(Parent application) U.S. Appl. No. 12/738,068, filed Apr. 14, 2010.
International Application No. PCT/US08/80794, Written Opinion dated Feb. 23, 2009.
International Application No. PCT/US09/41044, Written Opinion dated Jun. 5, 2009.
International Application No. PCT/US09/41044, Search Report dated Jun. 5, 2009.
International Application No. PCT/US08/57105, International Preliminary Report on Patentability, mailed Mar. 12, 2010.
Roman, E., et al. Experimental results of controlled PV Module for building integrated PV systems; Science Direct; Solar Energy, vol. 82, Issue 5, May 2008, pp. 471-480.
Verhoeve, C.W.G., et al., Recent Test Results of AC-Module inverters, Netherlands Energy Research Foundation ECN, 1997.
Stern M., et al., Development of a Low-Cost Integrated 20-kW-AC Solar Tracking Subarray for Gid-Connected PV Power System Applications—Final Report, National Renewable Energy Laboratory, Jun. 1998.
Schoen, T.J.N., BIPV overview & getting PV into the marketplace in the Netherlands, The 2nd World Solar Electric Buildings Conference: Sydney Mar. 8-10, 2000.
Knaupp, W. et al., Operation of A 10 kW PV facade with 100 W AC photovoltaic modules, 25th PVSC; May 13-17, 1996; Washington D.C.
Linares, L., et al., Improved Energy Capture in Series String Photovoltaics via Smart Distributed Power Electronics; Proceedings APEC 2009: 24th Annual IEEE Applied Power Electronics Conference, Washington, D.C., Feb. 2009.
International Application No. PCT/US08/80794, Search Report dated Feb. 23, 2009.
International Application No. PCT/US08/79605, Written Opinion dated Feb. 3, 2009.
International Application No. PCT/US08/79605, Search Report dated Feb. 3, 2009.
Edelmoser, K. H. et al.; High Efficiency DC-to-AC Power Inverter with Special DC Interface; Professional Paper, ISSN 0005-1144, Automatika 46 (2005) 3-4, 143-148.
Esmaili, Gholamreza; Application of Advanced Power Electronics in Renewable Energy Sources and Hygrid Generating Systems, Ohio State University, Graduate Program in Electrical and Computer Engineering, 2006, Dissertation.
Jung, D; Soft Switching Boost Converter for Photovoltaic Power Generation System, 2008 13th International Power Electronics and Motion Control Conference (EPE-PEMC 2008).
Joo, Hyuk Lee; "Soft Switching Multi-Phase Boost Converter for Photovoltaic System," Power Electronics and Motion Control Conference, 2008. EPE-PEMC 2008. 13th Sep. 1, 2008.
Kuo, J.-L.; "Duty-based Control of Maximum Power Point Regulation for Power Converter in Solar Fan System with Battery Storage," Proceedings of the Third IASTED Asian Conference, Apr. 2, 2007, Phuket, Thialand.
Enslin, J.H.R.; "Integrated Photovoltaic Maximum Power Point Tracking Converter;" Industrial Electronics, IEEE Transactions on vol. 44, Issue 6, Dec. 1997, pp. 769-773.
Dehbonei, Hooman; Corp author(s): Curtin University of Technology, School of Electrical and Computer Engineering; 2003; Description: xxi, 284 leaves; ill.; 31 cm. Dissertation: Thesis. Abstract.
Duncan, Joseph, A Global Maximum Power Point Tracking DC-DC Converter, Massachussetts Institute of Technology, Dept. of Electrical Engineering and Computer Science Dissertation; Jan. 20, 2005.
Enrique, J.M.; Duran, E; Sidrach-de-Cadona, M; Andujar, JM; "Theoretical Assessment of the Maximum Power Point Tracking Efficiency of Photovoltaic Facilities with Different Converter Topologies;" Source: Solar Energy 81, No. 1 (2007); 31 (8 pages).
Association for Applied Solar Energy, Alt. Journal; Uniform Title: Solar energy (Photnix, AZ); Key Title: Solar energy; Preceding Title: Journal of solar energy, science and engineering; Standard No. ISSN: 0038-092X CODEN: SRENA4. No abstract available.
Tse, K.K.et al. "A Novel Maximum Power Point Tracking Technique for PV Panels;" Dept. of Electronic Engineering, City Univerisity of Hong Kong; Source: PESC Record—IEEE Annual Power Electronics Specialists Conference, v 4, 2001, p. 1970-1975, Jun. 17-21, 2001; Abstract.
Mutoh, Nobuyoshi; A Photovoltaic Generation System Acquiring Efficiently the Electrical Energy Generated with Solar Rays,; Graduate School of Tokyo, Metropolitan Institute of Technology; Source: Series on Energy and Power Systems, Proceedings of the Fourth IASTED International Conference on Power and Energy Systems, Jun. 28-30, 2004; p. 97-103. Abstract.
Rajan, Anita; "Maximum Power Point Tracker Optimized for Solar Powered Cars;" Society of Automotive Engineers, Transactions, v 99, n Sect 6, 1990, p. 1408-1420; Abstract.
Mutoh, Nobuyoshi, "A Controlling Method for Charging Photovoltaic Generation Power Obtained by a MPPT Control Method to Series Connected Ultra-electric Double Layer Capacitors;" Intelligent Systems Department, Faculty of Engineering, Graduate School of Tokyo; 39th IAS Annual Meeting (IEEE Industry Applications Society); v 4, 2004, p. 2264-2271. Abstract.
Ho, Billy M.T.; "An Integrated Inverter with Maximum Power Tracking for Grid-Connected PV Systems;" Department of Electronic Engineering, City University of Hong Kong; Conference Proceedings, 19th Annual IEEE Applied Power Electronics Conference and Exposition, Feb. 22-26, 2004; p. 1559-1565.
Esram, T., Chapman, P.L., "Comparison of Photovoltaic Array Maximum Power Point Tracking Techniques," Energy Conversion, IEEE Transactions, Vo. 22, No. 2, pp. 439-449, Jun. 2007.
Nishida, Yasuyuki, "A Novel Type of Utility-interactive Inverter for Photovoltaic System," Conference Proceedings, IPEMC 2004; 4th International Power and Electronics Conference, Aug. 14-16, 2004; Xian Jiaotong University Press, Xian, China; p. 1785-1790. Abstract.
Anon Source; International Symposium on Signals, Circuits and Systems, Jul. 12-13, 2007; Iasi, Romania; Publisher: Institute of Electrical and Electroncis Engineers Computer Society; Abstract.
Case, M.J.; "Minimum Component Photovoltaic Array Maximum Power Point Tracker," Vector (Electrical Engineering), Jun. 1999; p. 4-8; Abstract.
Xue, John, "PV Module Series String Balancing Converters," Supervised by Geoffrey Walker, Nov. 6, 2002; University of Queensland, School of Information Technology and Electrical Engineering.
Siri, K; "Study of System Instability in Current-mode Converter Power Systems Operating in Solar Array Voltage Regulation Mode," Dept. of Electrical and Electronic Systems, Aerospace Corp., El Segundo, CA; Feb. 6-10, 2000 in New Orleans, LA, 15th Annual IEEE Applied Power Electronics Conference and Exposition, pp. 228-234.
Reimann, T, Szeponik, S; Berger, G; Petzoldt, J; "A Novel Control Principle of Bi-directional DC-DC Power Conversion," 28th Annual IEEE Power Electroncis Specialists Conference, St. Louis, MO Jun. 22-27, 1997; vol. 2 pp. 978-984. Abstract.
Kaiwei, Yao, Mao, Ye; Ming, Xu; Lee, F.C.; "Tapped-inductor Buck Converter for High-step-down DC-DC Conversion," IEEE Transactions on Power Electronics, vol. 20, Issue 4, Jul. 2005; pp. 775-780; Abstract.
Ertl, H; Kolar, J.W.; Zach, F.C.; "A Novel Multicell DC-AC Converter for Applications in Renewable Energy Systems;" IEEE Transactions on Industrial Electronics, Oct. 2002; vol. 49, Issue 5, pp. 1048-1057; Abstract.
Bascope, G.V.T.; Barbi, I; "Generation of a Family of Non-isolated DC-DC PWM Converters Using New Three-state Switching Cells;" 2000 IEEE 31st Annual Power Electronics Specialists Conference in Galway, Ireland; vol. 2, pp. 858-863; Abstract.
Duan, Rouo-Yong; Chang, Chao-Tsung; "A Novel High-efficiency Inverter for Stand-alone and Grid-connected Systems," 2008 3rd IEEE Conference on Industrial Electronics and Applications in Singapore, Jun. 3-5, 2008; Article No. 4582577. Abstract.
Cuadras, A; Ben Amor, N; Kanoun, O; "Smart Interfaces for Low Power Energy Harvesting Systems," 2008 IEEE Instrumentation and Measurement Technology Conference May 12-15, 2008 in Victoria, BC Canada; pp. 78-82 and 12-15. Abstract.
Quan, Li; Wolfs, P; "An Analysis of the ZVS Two-inductor Boost Converter Under Variable Frequency Operation," IEEE Transactions on Power Electronics, Central Queensland University, Rockhamton, Qld, AU; vol. 22, No. 1, Jan. 2007; pp. 120-131. Abstract.

Yuvarajan, S; Dachuan, Yu; Shanguang, Xu; "A Novel Power Converter for Photovoltaic Applications," Journal of Power Sources, Sep. 3, 2004; vol. 135, No. 1-2, pp. 327-331; Abstract.
Power Article, Aerospace Systems Lab, Washington University, St. Louis, MO; estimated at Sep. 2007.
International Application No. PCT/US08/60345, International Search Report dated Aug. 18, 2008.
International Application No. PCT/US08/60345, Written Opinion dated Aug. 18, 2008.
International Application No. PCT/US08/57105, International Search Report dated Jun. 25, 2008.
International Application No. PCT/US08/57105, Written Opinion dated Jun. 25, 2008.
International Application No. PCT/US08/70506, International Search Report dated Sep. 26, 2008.
International Application No. PCT/US08/70506, Written Opinion dated Sep. 26, 2008.
Chen, J., et al. Buck-Boost PWM Converters Having Two Independently Controlled Switches, IEEE Power Electronics Specialists Conference, Jun. 2001, vol. 2, pp. 736-741.
Walker, G. et al. PhotoVoltaic DC-DC Module Integrated Converter for Novel Cascaded and Bypass Grid Connection Topologies—Design and Optimisation, 37th IEEE Power Electronics Specialists Conference / Jun. 18-22, 2006, Jeju, Korea.
Chen, J., et al. A New Low-Stress Buck-Boost Converter for Universal-Input PFC Applications, IEEE Applied Power Electronics Conference, Feb. 2001.
International Application No. PCT/US08/70506 corrected International Preliminary Report on Patentability, mailed Jun. 25, 2010.
SM3320 Power Optimizer Specifications; SolarMagic Power Optimizer Apr. 2009.
Feuermann, D. et al., Reversible low solar heat gain windows for energy savings. Solar Energy vol. 62, No. 3, pp. 169-175, 1998.
International Patent Application No. PCT/US08/60345. International Prelimianry Report on Patentability dated Aug. 30, 2010.
TwentyNinety.com/en/about-us/, printed Aug. 17, 2010; 3 pages.
National Semiconductor News Release—National semiconductor's SolarMagic Chipset Makes Solar Panels "Smarter" May 2009.
U.S. Appl. No. 61/252,998, filed Oct. 19, 2009, entitled Solar Module Circuit with Staggered Diode Arrangement.
Parallel U.S. Appl. No. 12/682,882; Nonfinal Office Action dated Sep. 27, 2010.
Parallel U.S. Appl. No. 12/682,882; Examiner's Interview Summary dated Oct. 20, 2010; mailed Oct. 26, 2010.
Parallel U.S. Appl. No. 12/738,068; Examiner's Interview Summary dated Oct. 20, 2010.
Parallel U.S. Appl. No. 12/682,559; Nonfinal Office Action dated Dec. 10, 2010.
European Patent Application No. 07 873 361.5 Office Communication dated Jul. 12, 2010 and applicant's response dated Nov. 22, 2010.
International Patent Application No. PCT/US2008/079605. International Preliminary Report on Patentability dated Jan. 21, 2011.
Parallel U.S. Appl. No. 12/738,068; Examiner's Interview Summary dated Feb. 3, 2011.
Parallel U.S. Appl. No. 12/682,882; Examiner's Interview Summary dated Feb. 3, 2011.
Parallel U.S. Appl. No. 12/682,559; Examiner's Interview Summary dated Feb. 4, 2011.
International Patent Application No. PCT/US2010/053253. International Search Report and International Written Opinion of the International Searching Authority dated Feb. 22, 2011.
Parallel U.S. Appl. No. 12/682,559; Final Office Action dated Mar. 3, 2011.
Parallel U.S. Appl. No. 12/738,068; Notice of Allowance dated Feb. 24, 2011.
Parallel U.S. Appl. No. 12/955,704; Nonfinal Office Action dated Mar. 8, 2011.
Parallel U.S. Appl. No. 12/682,882; Final Office Action dated May 13, 2011.
Parallel U.S. Appl. No. 12/995,704; Notice of allowance dated Jul. 19, 2011.
International Application No. PCT/US09/41044; International Preliminary Report on Patentabiity dated Jul. 6, 2011.
Parallel U.S. Appl. No. 12/682,882; Notice of allowance dated Sep. 9, 2011.
Parallel U.S. Appl. No. 12/682,559; Nonfinal office action dated Sep. 23, 2011.
Parallel U.S. Appl. No. 13/275,147; Nonfinal office action dated Dec. 29, 2011.
Parallel U.S. Appl. No. 13/059,955; Nonfinal office action dated Jan. 23, 2012.
International Application No. PCT/US10/53253; International Preliminary Report on Patentabiity dated Jan. 25, 2012.
Parallel U.S. Appl. No. 12/682,559; Notice of allowance dated Apr. 17, 2012.
International Application No. PCT/US08/80794; International Preliminary Report on Patentabiity dated May 8, 2012.
Parallel U.S. Appl. No. 13/078,492; Nonfinal office action dated May 16, 2012.
Parallel U.S. Appl. No. 13/192,329; Final office action dated Jun. 13, 2012.
Parallel CN Patent Application No. 200880121101.7; office action dated Sep. 26, 2011.
Parallel CN Patent Application No. 200880121101.7; office action dated Jun. 11, 2012.
Parallel U.S. Appl. No. 13/192,329; Notice of Allowance dated Jul. 30, 2012.
International Application No. PCT/2012/022266, International Search Report dated Jul. 24, 2012.
International Application No. PCT/2012/022266, Written Opinion of the International Searching Authority dated Jul. 24, 2012.
U.S. Appl. No. 13/275,147; Final office action dated Aug. 24, 2012.
Chinese Patent Application No. 200880121009.0, Office Action dated Aug. 31, 2012.
U.S. Appl. No. 13/059,955; Final office action dated Sep. 27, 2012.
Singapore Patent Application No. 201107477-0; written opinion dated Nov. 27, 2012.
Japanese Patent Application No. 2010-529991; office action dated Dec. 18, 2012.

* cited by examiner

POWER CAPACITOR ALTERNATIVE SWITCH CIRCUITRY SYSTEM FOR ENHANCED CAPACITOR LIFE

This application is a continuation of U.S. application Ser. No. 12/738,068, filed Apr. 14, 2010, which is the United States National Stage of International Application No. PCT/US2008/080794, Filed 22 Oct. 2008, and which claims benefit of and priority to U.S. Provisional Application No. 60/986,979 filed Nov. 9, 2007, and U.S. Provisional Application No. 60/982,053 filed Oct. 23, 2007, each hereby incorporated herein by reference.

TECHNICAL FIELD

This invention relates generally to the field of designing and supplying DC power internally or externally in a device such as where low frequency AC ripple may be present. It has particular application to the technical field of power factor correction circuitry and to circuitry for solar power, specifically, methods and apparatus for converting electrical power from some type of solar energy source to make it available for use in a variety of applications. In the field of solar power it can be particularly useful in providing methods and apparatus for grid- or electrical power network-tied photovoltaic (PV) converters such as in large solar arrays as well as in residential or low to moderate power installations.

BACKGROUND

The use of electrolytic capacitors in DC power electronics has been pervasive since early radio and television days. They provide the necessary function of smoothing voltage while conducting widely varying current. Electrically this may be achieved by having a large capacitance value. Chemically this large capacitance is accomplished by having an ionic conducting liquid as one of its plates. By nature these capacitors may dry out or have other issues causing short lifetimes compared to other commonly used power conversion components. The common approach to achieve the desired lifetimes for power conversion equipment is to provide huge operational margins so as not to overly stress the electrolytic capacitor. This only provides marginal improvement. This invention discloses an electrical circuit that may be useful in a wide variety of applications and which achieves the desirable benefit of smoothing while experiencing AC current ripple without the use of any short lifetime components. This circuit may use switchmode power conversion technology to also maintain low losses.

It can be helpful to understand the need for this invention in the context of a particular application, such as a solar power system or power factor correction circuitry as is often used internally in many varying devices. In merely an exemplary context of photovoltaic (PV) systems, many common PV converters may have typical lifetime limits of about five years or so. Such a lifetime may be inconsistent with the fact that PV panels or solar panels can in some instances need to be viewed from the perspective of generating their electricity savings for payback of initial investment over longer periods. The present invention provides systems that may in some embodiments address the lifetime limits for many current PV converters. It may provide systems that extend the lifetime of a grid tied PV converter for single phase power installation to lifetimes of even several decades.

At the current time the use of PV panels to generate electricity may be in a period of rapid growth. The cost of solar power may even be decreasing and many factors appear to limit the growth of non-renewable energy sources. Today there are both large scale systems and small scale systems being deployed. For the large systems power is often supplied in three-phase connections which may not require large amounts of energy storage per cycle. For smaller installations like residential, single phase power is frequently delivered. In a typical system, one or many PV panels may be connected to a grid-tied converter which may take the steady power from the PV panel, perhaps at its maximum power point, and may then transform it to AC power suitable to back-feeding the grid or other electrical power network. For single phase, power delivery energy storage may be required every cycle. Today this energy storage often accomplished with short lived components—electrolytic capacitors. The present invention overcomes this limitation in a manner that can practically increase the life of the PV converter componentry.

DISCLOSURE OF THE INVENTION

As mentioned with respect to the field of invention, the invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

In various embodiments, the present invention discloses achievements, systems, and different initial exemplary applications through which one may achieve some of the goals of the present invention. Systems provide for replacement components and enhanced power control, among other aspects. Through a variety of different aspects, the invention provides more reliability to a variety of circuitries. The invention provides: 1) a replacement system approach, 2) highly reliable switch-mode topologies, 3) a system that provides an altered interim internal signal, 4) unique control techniques that provide long lived devices, 5) unique switching designs and circuits, and 6) devices and circuit inserts that can be broadly applied. Each of these may exist independently of any other and are discussed below.

In general, it is possible to using switchmode or other power conversion technology with the new circuitry systems to emulate the high capacitance of an electrolytic capacitor for many operational requirements. These circuits can use a longer life lower value capacitor which could be a film capacitor for example that could be used in power factor correction circuitry, in solar power converters, or the like. In this patent a film capacitor is used as an example of any non-electrolytic capacitor that has a longer life. In certain embodiments, a switchmode power conversion circuit can operate in such a way that the voltage on the film capacitor varies over a large range to affect the same cycle-by-cycle energy storage while at the same time maintaining a relatively constant voltage across designated terminals. Although there are applications where electrolytic capacitors are used for one-time needs, like hold-up, where the circuit of the invention may not be necessary, in many applications long life is desired. The fundamental application of the circuit of the invention is where lower frequency cycle-by-cycle energy storage or smoothing is desired. For example, the output capacitor of a power factor correction circuit could be replaced with this circuit. Another example is the energy storage capacitor used in solar inverters. Another example is the voltage smoothing occurring in an internal or external power supply in general.

In many solar power applications, a single phase grid-tied converter can be used to supply power to the grid, perhaps at a frequency of two times the grid frequency. For example with a 60 Hz grid, the output power may flow in pulses at a frequency of 120 Hz. The solar panel at the same time may only produce its maximum power at a steady rate. The converter then may be configured to retrieve the power from the PV panel at a steady rate (perhaps at a maximum power point), store the energy, and output the energy at either a pulsing rate, as smoothed DC, or as inverted AC. Internally the frequency of pulsing may be low and the amount of energy stored may be high (on the order of one joule per 100 watts of converter power). Some configurations may, and commonly do, use one type of electrical element as an inexpensive component for this type of energy storage and smoothing, an electrolytic capacitor. Use of electrolytic capacitors may involve many commonly available power conversion topologies and circuits. These may be well developed and are often deployed in current grid-tied power converter systems. In fact, electrolytic capacitors are in such widespread use that they are deployed in much less critical applications simply from common practice. Many current systems utilize a number of these electrolytic capacitors. For example, some current designs may have over 30 electrolytic capacitors each. It is a goal of some embodiments of the present invention to extend lifetime and perhaps significantly avoid lifetime limitations experienced by systems that utilize such topologies. Although there are applications where long life may not be necessary (perhaps such as some computer systems where a lifetime of five years is often adequate because the computer may be obsolete in this same time period) many applications do last long and long life remains necessary. A grid-tied PV system is but one example of a system where the initial installation and product cost can be high enough, and the economics of using such a system may be such that payback needs to be considered as power is generated or as the system or device is used over a long period of time. It may even involve long term financing perhaps with a term of 30 to 40 years. If the expectation is that the converter must be replaced every five or perhaps seven years, then there is an undesirable consequence that the converter must be replaced about four or more times over the life of the system or the investment.

Accordingly, it is an object of embodiments of the invention to provide a means and apparatus to utilize energy (such as, but not limited to, a PV panel, an internal DC or the like) and to supply desired power in a manner that provides economical, long lived, reliable components.

MODE(S) FOR CARRYING OUT THE INVENTION

As mentioned above, the invention discloses a variety of aspects that may be considered independently or in combination with others. Although shown in initial applications such as a solar power system or as an accessory for a device with factor correction, other applications can, of course, exist. Initial understandings can begin with understanding an embodiment as applied to a solar energy power system. Such a system may combine any of the following concepts and circuits including: an inverter, a converter, energy storage, switches, a controller and changeable functional control components. Aspects may include a very high efficiency photovoltaic converter. Initial benefits are discussed individually and in combination in the following discussion as well as how each represents a general group of designs rather than just those initially disclosed.

Figure 1:
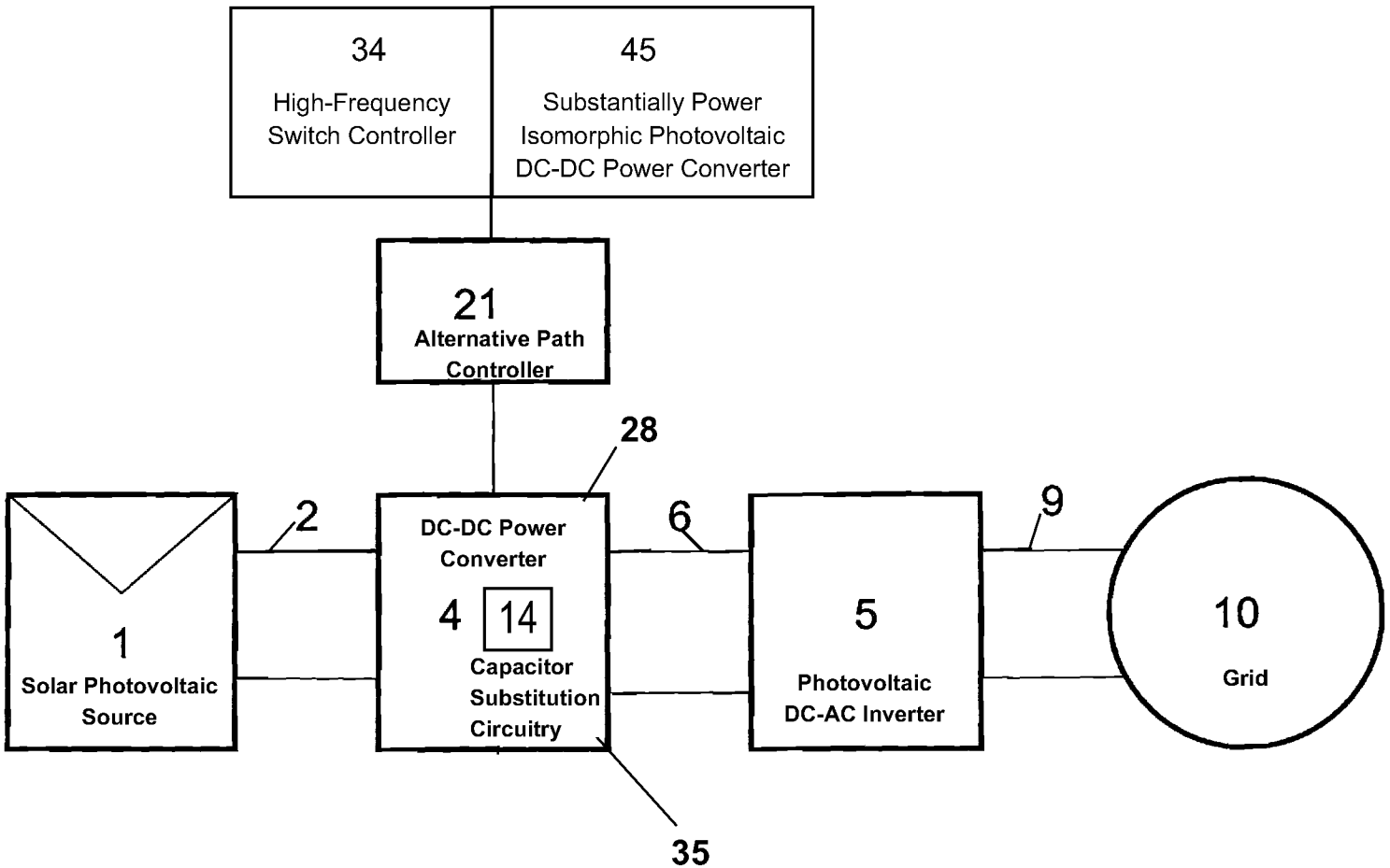
FIG. 1, shows a simplified schematic of a grid-tied solar power converter.

FIG. 1 shows one embodiment of a solar energy power system illustrating the basic conversion and inversion principles of the present invention. As shown, it involves a solar photovoltaic source (1) feeding into an enhanced DC-DC power converter (4) providing a smoothed DC output (6) to a photovoltaic DC-AC inverter (5) that may perhaps ultimately interface with a grid (10). As may be appreciated, the solar photovoltaic source (1) may be a solar cell, a solar panel, or perhaps even a string of panels. Regardless, the solar photovoltaic source (1) may create an output such as a DC photovoltaic input (2). This DC photovoltaic input (2) may be established as a DC photovoltaic input to the enhanced DC-DC power converter (4). Similarly, the enhanced DC-DC power converter (4) may create an output such as a smoothed DC output (6). This smoothed DC photovoltaic power output (6), or more generally photovoltaic DC converter output, may be established as an inverter input to a photovoltaic DC-AC inverter (5). Ultimately, the photovoltaic DC-AC inverter (5) may act to invert the converted DC and create an AC output such as a photovoltaic AC power output (9) which may be established as an input to a grid (10), a domestic electrical system, or both, or some other power consuming device or thing. Solar energy systems can have individual panels or may be a field of panels that generate solar energy electrical power.

Figure 2:
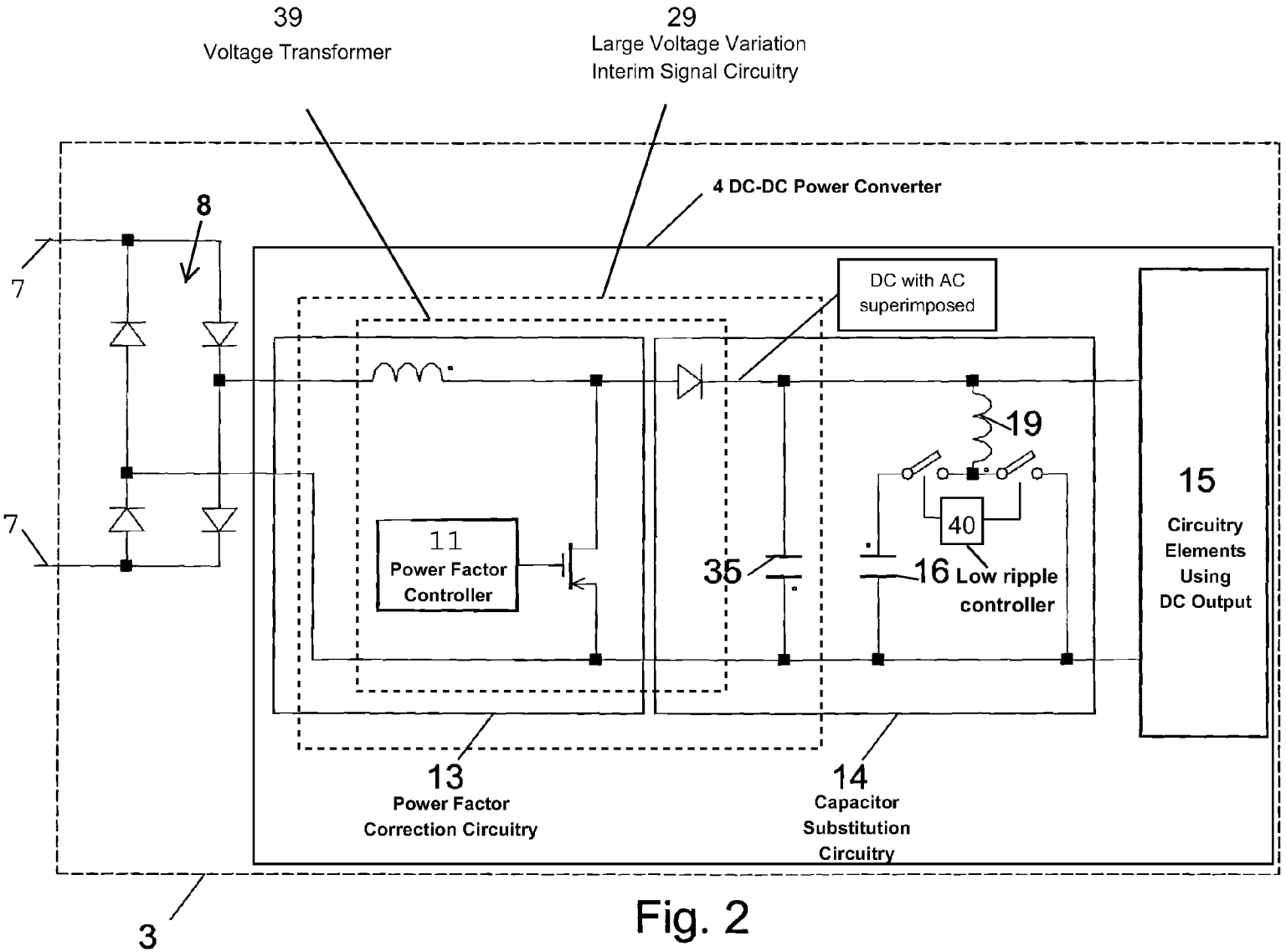
FIG. 2, shows a simplified schematic of a power factor correction circuitry component within a device with an enhanced power converter according to the present invention.

FIG. 2 illustrates a power factor correction accessory in a particular embodiment. When operating, a device (3) may utilize an AC input (7) that is acted upon by a rectifier element (8) to serve as operationally active power circuitry that creates an internal DC signal (12) and thus provide a DC energy source. This DC energy source may be corrected by power factor correction circuitry (13) that may include a power factor controller (11). The power factor controller (11) may act to correct phase and other effects as is well known. This internal DC signal (12) may be an internal, substantially DC device voltage that is actually an unsmoothed, substantially DC voltage that may merely be biased as DC. It may significantly depart from a traditional DC signal and may even have an alternating current component superimposed on a DC signal. According to the invention, embodiments may include capacitor substitution circuitry (14) that conditions and smoothes DC for use by other circuitry elements (15) within the device (3). As embodiments of the present invention demonstrate, it may be possible to replace electrolytic capacitors and use film or oil type capacitors for the energy storage elements. Any type of non-electrolytic capacitor should be considered for this invention. Of course, it is possible that many of these types of capacitors may store only a small amount of energy for a given volume. To put many of these in parallel to achieve the same amount of energy storage could thus require a very large volume of space, and perhaps a prohibitive cost. In the circuit of embodiments of the invention, a new way of deploying these types of capacitors may be combined with new topologies and techniques for power conversion. Together and alone, these may make it possible to meet the same performance requirements without undue additional expense. The resulting solution establishes some ways to achieve a 30 to 40 year life for components such as a grid-tied converter.

In prior art and common use today the electrolytic capacitor is often a large capacitance value element. The large value may exist from the need to carry large current. It may also be selected to minimize the voltage ripple. In solar power applications as but one example, a typical value for more common electrolytic capacitors may be 3 MF at 450 volts for a 4 kW power converter. In sharp contrast, in embodiments of the invention a film capacitor may be employed. Such a film capacitor may be much less capacitance, on the order of 50 uF—one tenth or even one hundredth or more times smaller. This film capacitor may have very large ripple voltage as well. To compare, the electrolytic capacitor ripple may be only a few volts. The film capacitor may have as much as hundreds of volts of ripple, or more. This large ripple may not cause any issue for the film capacitor; it may, however, involve significant changes in the power conversion topology and/or techniques.

Figure 3A:
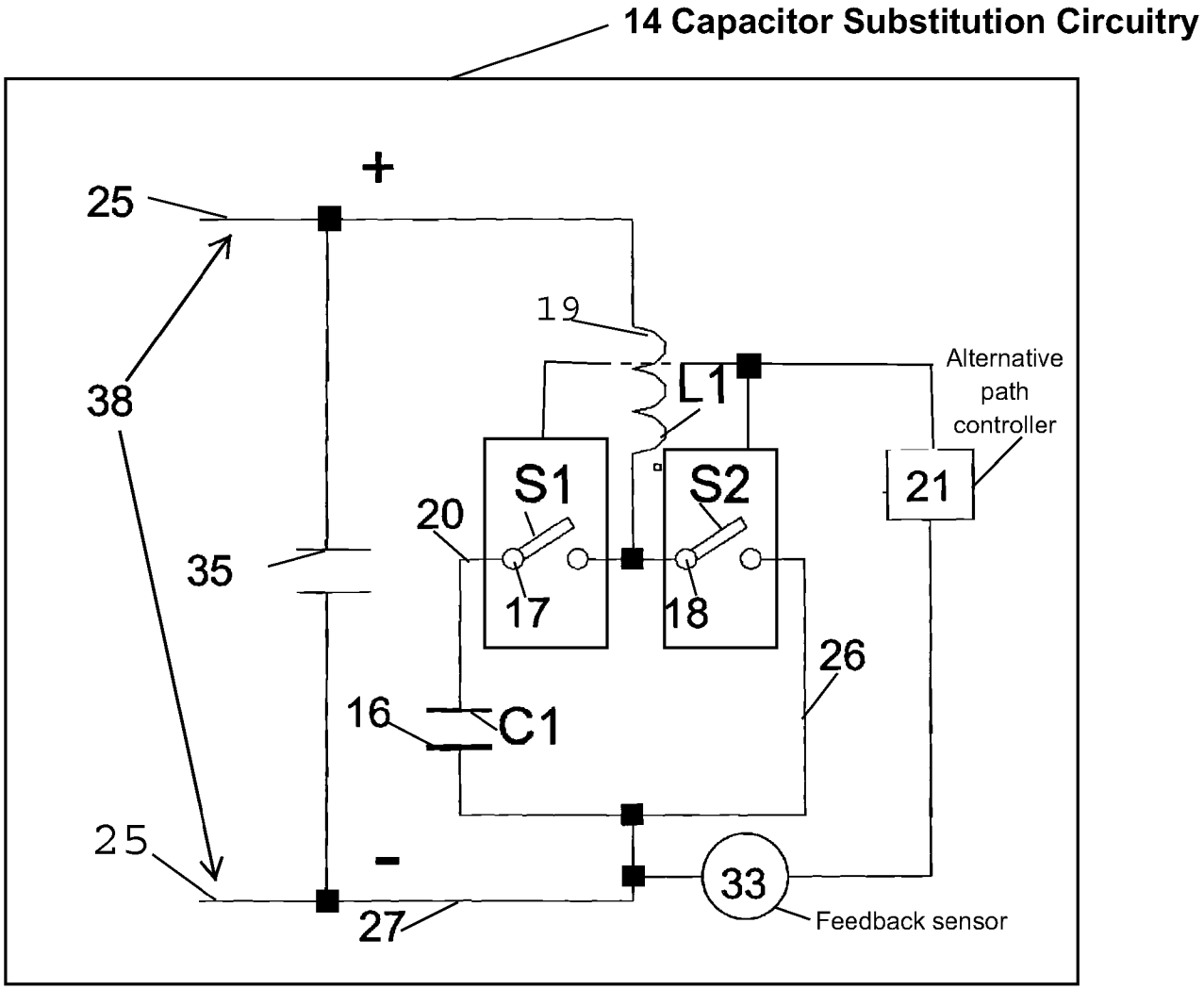
FIG. 3A is a schematic diagram of a single sided, two switch design of a circuitry component according to one embodiment of the invention.
Figure 3B:
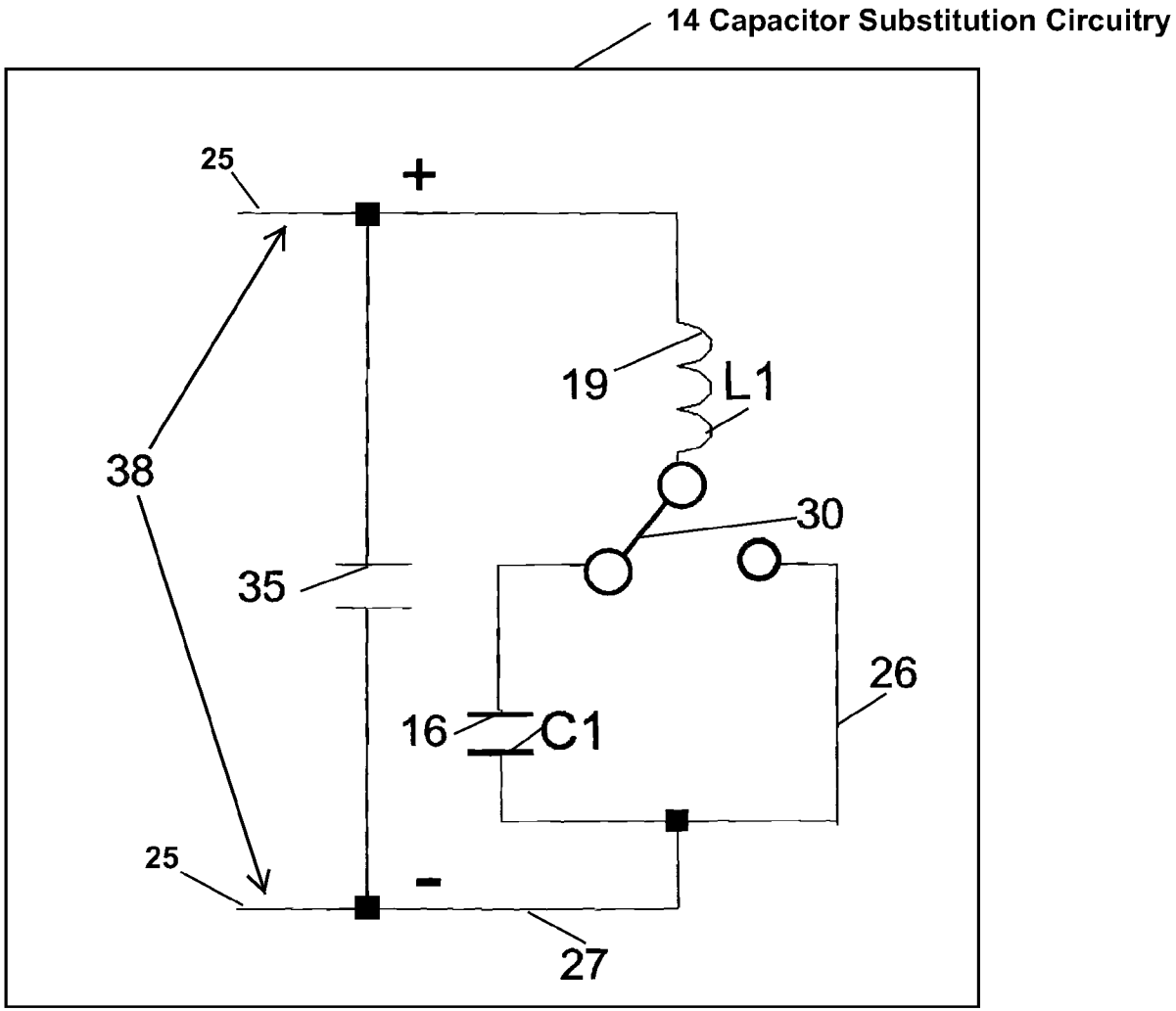
FIG. 3B is a schematic diagram of a single sided, single switch design of a circuitry component according to one embodiment of the invention.

FIGS. 3A & 3B illustrate particularly simplified embodiments of the capacitor substitution circuitry (14) shown as applied in FIGS. 1 and 2. FIG. 3A shows capacitor substitution circuitry (14). In this circuit, capacitor C1 (16) may be a lower value film capacitor having a long life. The operation of this circuit is as follows. The circuitry component accepts some type of DC energy from a DC energy source (25), likely as a DC voltage. This DC source may contain AC ripple current and so may not be smooth and thus needs to be acted upon to smooth or otherwise condition it. During the part of a cycle when current would flow into the electrolytic capacitor, current will now flow into the substitute circuit shown FIG. 3A. The two switches such as a first switch element 51 (17) and a second switch element (18) S2 may be paired. With two switches or the like, switch paired alternative path switching can be accomplished. This may include controlling operation so that there is deadtime alternative output switching is accomplished so that at no time are both switches ever both conducting. Deadtime alternative output switch circuitry (31) can be included perhaps within the alternative path controller (21) or as part of the enhanced DC-DC power converter (4) or the like.

Also included may be an inductive element L1 (19) and perhaps a film capacitor (16) that operate in a fashion similar to a boost converter, raising the voltage substantially on the film capacitor (16) for the duration current flows into the capacitor path (20) circuit. This may occur by including an alternate path controller (21) to operate the alternative path switch circuitry (24) such as the first and second switch elements (17) and (18) and alternately permit action in the capacitor path (20) or the alternative circuitry path (26). As shown, the capacitor path (20) or the alternative circuitry path (26) may be combined such as on a common lead (27). As in known boost converters, the duty cycle of switch S2 (18) may determine the boost current and the voltage being forced on capacitor (16). Switch S1 (17) could be thought of simply as a diode during this time. Thus the alternate path controller (21) may serve as a boost controller (22). Also at this time a control circuit configured as the more general aspect of an alternate path controller (21) may maintain the positive terminal voltage substantially constant. When the current into the positive terminal reverses, the function of the circuit whereby the switches S1 (17), S2 (18), inductor L1 (19), and capacitor C1 (16) may form a buck converter reducing the voltage across the film capacitor. Thus the alternate path controller (21) may also serve as a buck controller (23). At this time the duty cycle of switch S1 determines the ratio of the voltage across capacitor C1 (16) to the positive terminal voltage. Switch S2 (18) now can be thought of as a simple diode. The controller during this time may continue to maintain substantially constant voltage on the positive input terminal. The energy storage in terms of joules stored per cycle must of course be maintained. The film or other type of capacitor (16) may have a much lower capacitance value and thus may store this energy by operating over a large voltage swing, cycle-by-cycle. The inductive element L1 (19) may be chosen to buffer the peak current through the switches S1 and S2 (17) and (18). The switching frequency of S1 and S2 may be chosen to be large compared to the low frequency current impressed across the electrolytic. For example if the electrolytic capacitor was smoothing a 120 Hz ripple, a switching frequency of 50 kHz or higher may be used. In this case the energy stored in the inductive element (19) L1 may be small enough to be ignored in analyzing this circuit. As may be appreciated from FIG. 3B, a single double throw switch (30) may also be used.

The above embodiments are examples that illustrate how the invention can be used to replace or to design for a more long lasting capacitor. For example, an electrolytic capacitor operating at a nominal 400 volts and having a few volts of ripple superimposed on the 400 volts may be replaced with the circuit of the invention where the voltage on a smaller valued film capacitor may swing from 400 volts to 800 volts every cycle. While this may seem excessive, the film capacitor may not be degraded by this operation for decades where the electrolytic capacitor may only last a few years. The primary benefit of this circuit is realized in applications where long life expectancy is desired.

As may be appreciated, the capacitor (16) may act to smooth the ripple on the unsmoothed DC signal. The result may be a smoothed substantially constant DC voltage and this may be accomplished by operating the alternative path controller (21) as a smoothed signal maintenance controller. Depending on the parameters of operation, it may cause capacitive energy storage that has a maximum operative capacitor energy during operation. The element or elements operative store energy and operatively store a maximum operative capacitive energy, and this can be handled in a more optimal manner. This can be accomplished internally or it may be the external output of a system. By boosting the voltage, a smaller capacitor and an enhanced circuitry component can be used. Thus, the energy storage circuitry need not be a life limiting aspect for a wide variety of circuitries and devices. Since the energy stored in a capacitor can be expressed as $\frac{1}{2}CV^2$, and since the squared term—voltage excursion—is boosted, the replacement capacitor may considerable smaller. Where a particular sized, usually electrolytic, capacitor was once used, a replacement capacitor of one-tenth, one-twentieth, one-fiftieth, one-hundredth, or even more the size of the equivalent electrolytic capacitor can now be used. In absolute terms, for many applications, a replacement or newly designed in capacitor of 5 μF, 10 μF, 50 μF, 100 μF, or 500 μF or the like may now be used.

As may be appreciated from the fact that the energy stored ($\frac{1}{2}CV^2$) increases as the square of the voltage impressed upon the capacitor, a large voltage variation can be very beneficial. Embodiments act to create a large voltage variation that can be two, five, ten, fifty, or even more times the initial ripple amount. In general, embodiments may include interim signal circuitry (28) as part of the enhanced DC-DC power converter (4), as part of the capacitor substitution circuitry (14) or otherwise. This interim signal circuitry (28) may be almost transparent in that it may be internal and may act only as necessary to cause the desired effect on the capacitor (16). It may create the signal enhancement needed to permit a smaller capacitor to be used by boost and buck controlling operation or by utilizing a boost controller (22) and a buck controller (23) or the like.

An aspect that can facilitate the desired enhancement can be the aspect of utilizing switchmode circuitry such as shown. Semiconductor switches can be controlled in an open and closed, or on and off, state very easily. Thus, alternative switch circuitry that controls one of two or so alternative paths can be easily achieved. The capacitor path (20) or the alternative circuitry path (26) can be selected merely by alternately switching in a manner that an alternative output occurs such as by alternative output switching as shown. In some embodiments, it can be seen that the alternative circuitry path (26) may be configured across the capacitor and may itself be a substantially energy storage free circuitry path such as shown by a plain wire connection where inherent inductances and capacitances can be ignored in the circuitry design or effects.

In considering a switchmode nature of operational control, it can be understood that operating the alternative switch circuitry (24) or the alternative path controller (21) may be controlled or configured to achieve duty cycle switching. By duty cycle controlling operation changes in the output or the operation can be achieved by simply changing the duty cycle between the two alternative paths. Thus the alternative path controller (21) may be configured or programmed to serve as a switch duty cycle controller (32). One way in which this can be easily controlled can be by providing a feedback sensor (33). This feedback sensor (33) may act to sense any parameter, however, the output voltage may be a very direct parameter. The feedback sensor (33) may serve as an output voltage feedback sensor and may thus achieve control according to the result desired, likely an average voltage for the smoothed DC output (6). All of this may be easily accomplished by simply varying the duty cycle of operation and by switch duty cycle controlling operation. As can be easily appreciated from the simplified design shown in FIG. 3A, energy may be stored in multiple energy storage locations. This energy may be more than merely inherent effects and may be substantial energy from the perspective of either a smoothing effect or a component limit protection effect. Multiple substantial energy storage locational circuitry may provide for energy to be stored in both an inductor and a capacitor. These two different characters of energy, inductive and capacitive, can provide multiple character energy storage components. As shown from the location of the first switch element (17), a switch may be positioned between the energy storage locations. This can be conceptually considered as permitting storage and use of the energies involved at differing times. The circuit may even alternate between using or storing at these two locations.

In considering the effects of the inductive element (19), it can be appreciated that this aspect may merely be designed to serve to limit the current to which the first and second switch element (17) and (18) may be subjected. It may thus serve as a switch current limit inductor. As such, its energy may be significantly less that the energy stored in the capacitor (16). For example, considering the inductive energy storage as having a maximum operative inductor energy that is the amount of energy to which the inductive element (19) is subjected throughout a particular mode of normal operation or operative stored, it can be understood that this inductive energy storage may be considerably smaller that the energy stored in the capacitor (16). The capacitor's energy may be about two, five, or even about ten or more times as big as said maximum operative inductor energy.

In considering the size of the inductive element (19), the speed with which alternate switching between alternative paths may occur can have significant effects. Designs may have the alternative path controller (21) serve as a switch frequency controller (34). As mentioned above, the frequency of alternative switching may be considerably higher than that of a superimposed ripple. Thus the switch frequency controller (34) may be configured as a high frequency switch controller. Using the previous example of a 120 Hz ripple and a 50 kHz controller, it can be appreciated that the switch frequency can be at least about 400 times as fast. High frequency switch controllers at least about one hundred, five hundred, and even a thousand times the underlying predominant frequency of a superimposed ripple, AC component, or the like can be included. This level of switch frequency controlling operation can serve to reduce the size of the inductive element (19). As discussed below it can also reduce the size and energy of a bypass capacitor, and it can decrease the size of the ripple, as may each be desired for certain applications. Further, high frequency switch-mode converting can be easily achieved and thus designs can include a high frequency switch-mode controller that may even be operated at a rate one thousand times a predominant ripple frequency switch controller's rate.

With respect to ripple, the alternative path controller (21) can serve as a low ripple controller (40). If internal, the invention can provide an internal low ripple DC voltage to other circuitry. Perhaps even by merely controlling the output voltage in this manner, the alternative path controller (21) can achieve low ripple controlling. For any remaining ripple, a full circuit component bypass capacitor (35) can also be included as shown in several of the figures. This bypass capacitor (35) can smooth the irregularities of power caused at the high frequency switch operational level and can thus be considered a high frequency operative energy storage bypass capacitor. It can serve to store high frequency energy and can thus be sized as a greater than high frequency cycle-by-cycle energy storage bypass capacitor. Since this frequency can be considerably higher than the superimposed original ripple, the bypass capacitor (35) can be a relatively small capacitor.

In creating designs, there may be operational limits to consider for the embodiment of the circuit shown in FIG. 3A and otherwise. First, the range of voltage across the film capacitor could be determined. The low limit may be simply the DC operational voltage expected on the output terminals. That is, the voltage on the film capacitor may be equal to or greater than the output voltage. The high limit for the voltage will be determined by the voltage rating of the capacitor and switches. There are practical trade-offs an engineer skilled in the art will likely apply. To store a given amount of energy it may be more practical in one case to simply increase the value of the film capacitor. In another case it may be preferable to simply increase the maximum voltage allowed on the capacitor. Since the energy stored in a capacitor is $\frac{1}{2}CV^2$ with C being the capacitance in Farads and V the voltage in volts. This whole energy may also not be available as there is a minimum voltage equal to the circuit output voltage. However, with the teaching of the present invention it is possible to design an optimized circuit from the start or even to replace and reconfigure an existing circuit. In achieving a capacitor optimized circuit design, or in achieving a circuit alteration, those skilled in the art may accept an initial circuitry or an initial circuitry design and may alter it to achieve a better design. This may involve removing exiting circuitry or initial capacitive componentry or altering a traditional design in a manner that simply inserts a larger voltage variation signal or inserts interim signal circuitry and lower capacitance componentry in place to implement an altered circuit design. In designing the appropriate original or replacement components, a designer may assess a maximum capacitor voltage and may determine a minimum capacitor size needed to capacitively smooth a DC output. This may involve establishing a smooth DC energy signal criterion and then selecting frequencies, switches, and a capacitor that each strikes an appropriate balance from a practical perspective. Component selection can be balanced the trade-offs and can use a relatively high voltage capacitor, a relatively high voltage film capacitor, a relatively high voltage or current tolerant element or elements that balance costs with an enhanced life desired.

Figure 5A:
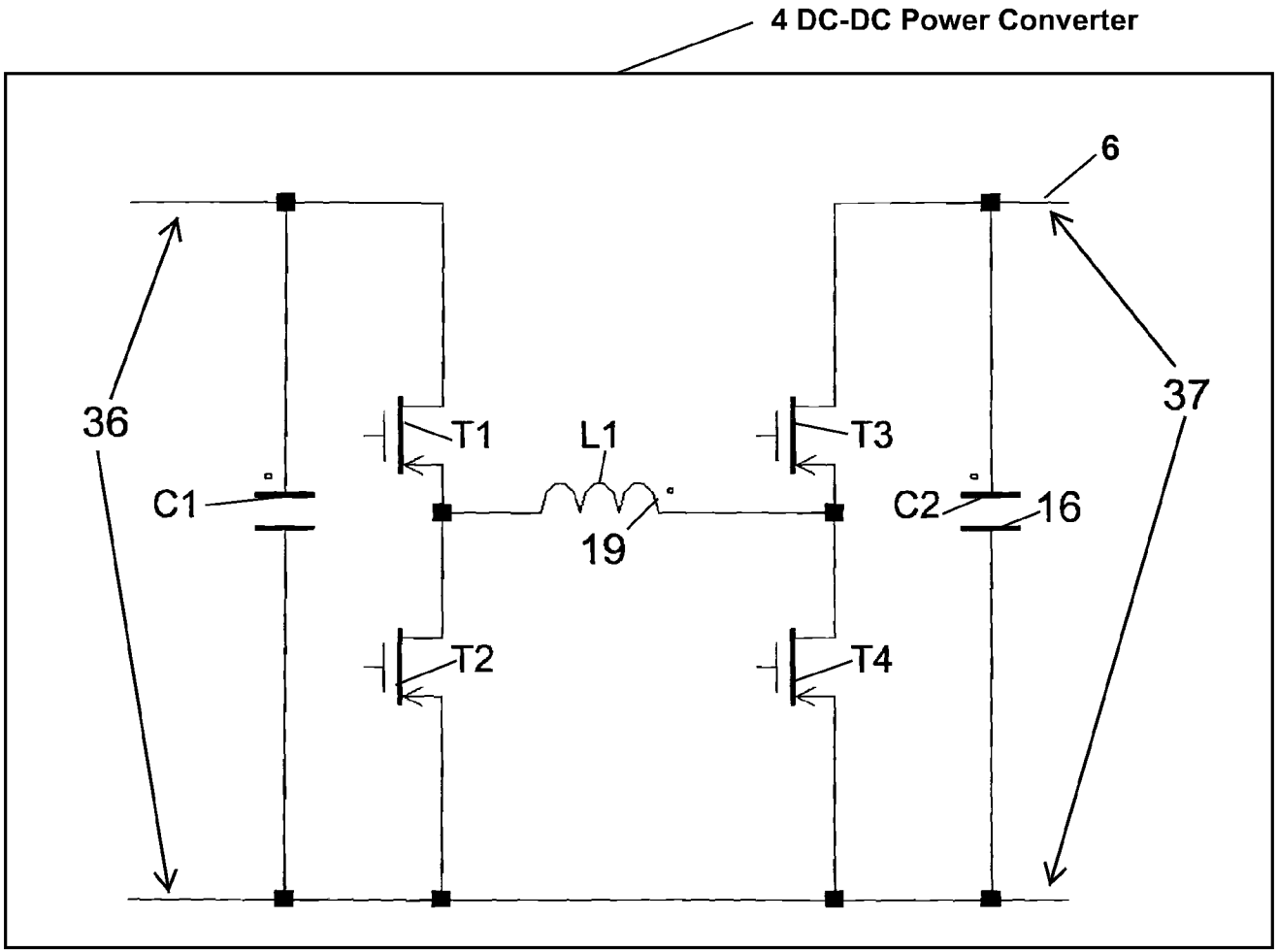
FIG. 5A is a schematic diagram of a two sided, four switch design of a circuitry component according to one embodiment of the invention.
Figure 5B:
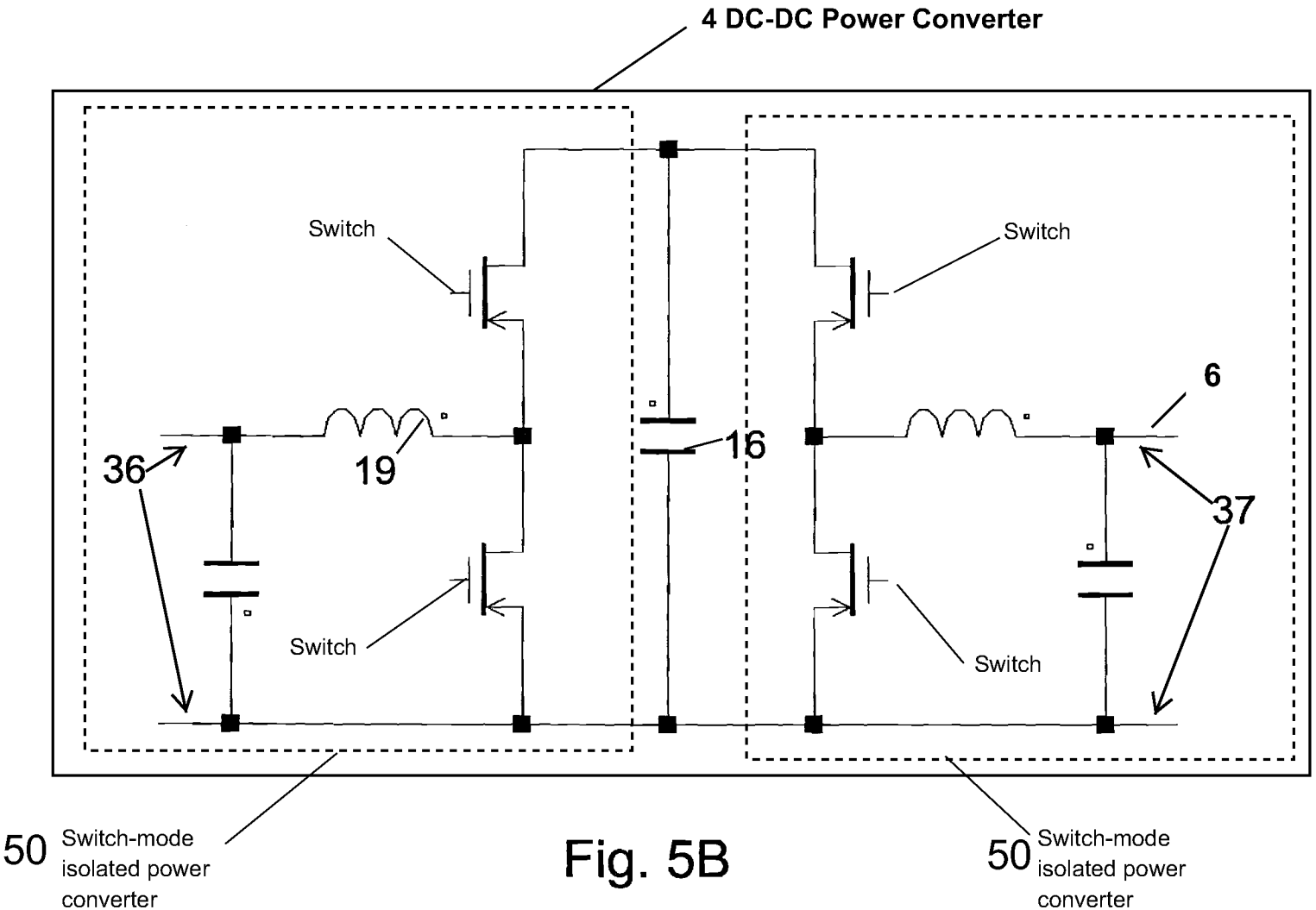
FIG. 5B is a schematic diagram of an alternative two sided, four switch design of a circuitry component according to one embodiment of the invention.
Figure 5C:
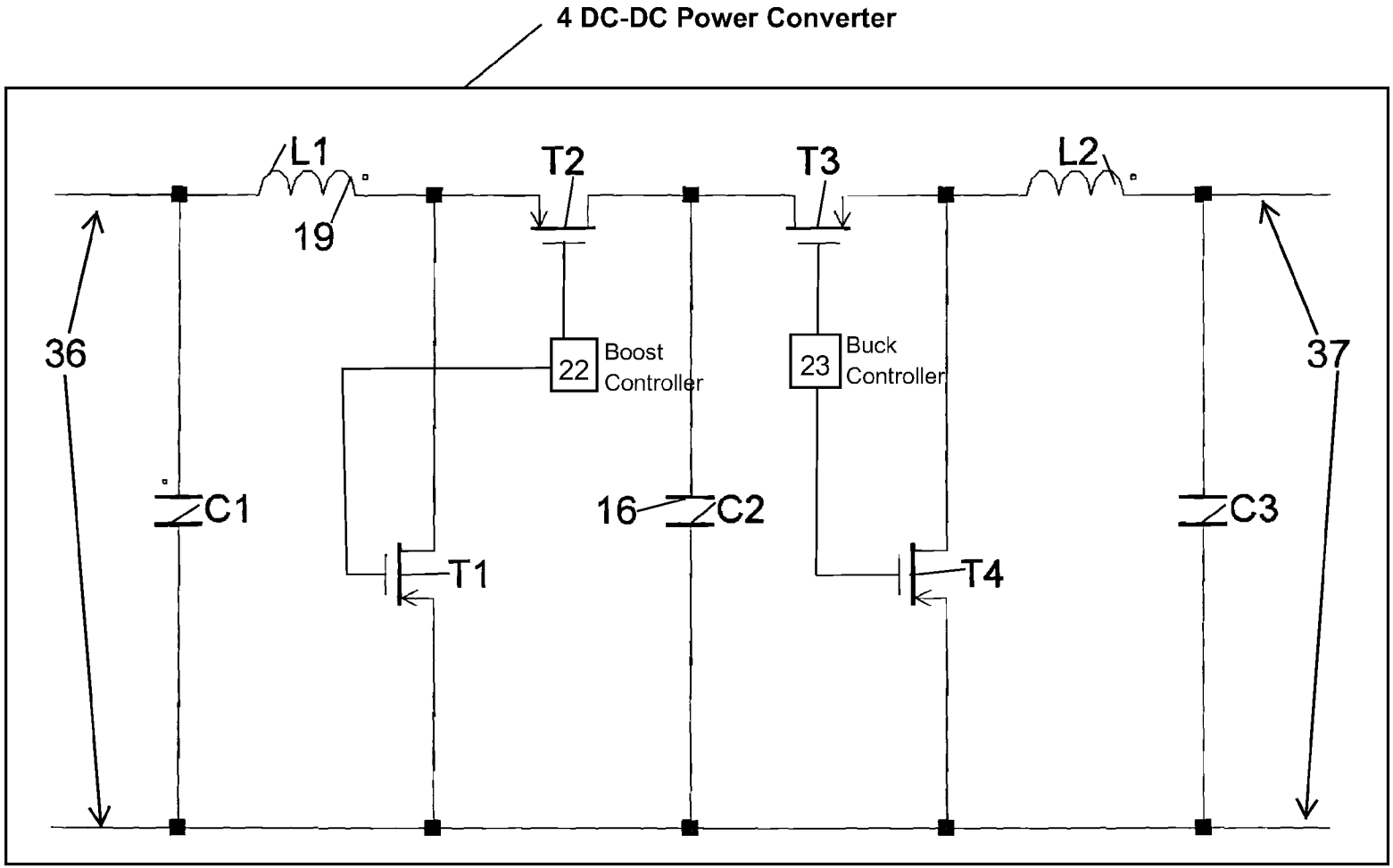
FIG. 5C is a schematic diagram of yet another two sided, four switch design of a circuitry component according to one embodiment of the invention.

As mentioned initially, many alternative embodiments according to the invention are possible. FIGS. 5A, 5B, and 5C each show embodiments with a more traditional circuit input connection (36) and a separate circuit output connection (37). In FIG. 5C, the input section C1, L1, T1, T2, may be considered as a boost converter as described previously. The energy storage capacitor C2 (16) may be a film capacitor having a substantial cycle by cycle voltage swing. The output stage T3, T4, L2, C3, may be considered a buck converter providing a constant output voltage. In a solar application, the output could be provided to an inverter to drive the grid. In this example there are a few benefits. Primarily solar inverters are required to have long lifetimes—perhaps as long as 30 years. Replacing the electrolytic capacitors is absolutely necessary to achieve this lifetime. Another benefit is that this replacement of the electrolytic capacitor does not require the inverter/grid driver section to operate at a variable input voltage. This allows the inverter to attain a high efficiency. Also, the input and output voltages may differ. This also allows design flexibility.

Figure 4A:
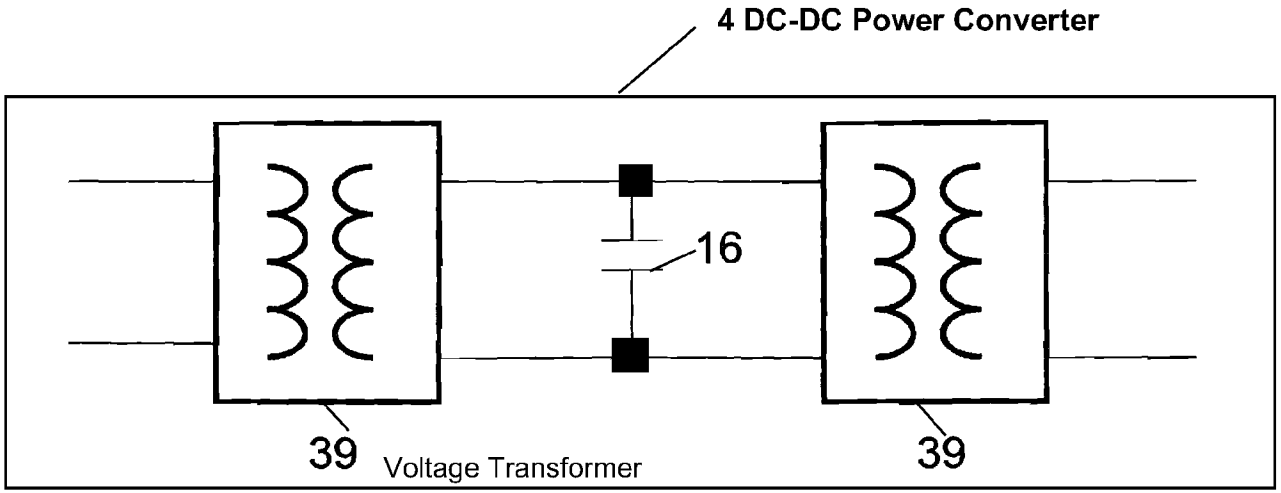
FIG. 4A is a schematic diagram of a two sided transformer design of a circuitry component according to one embodiment of the invention.
Figure 4B:
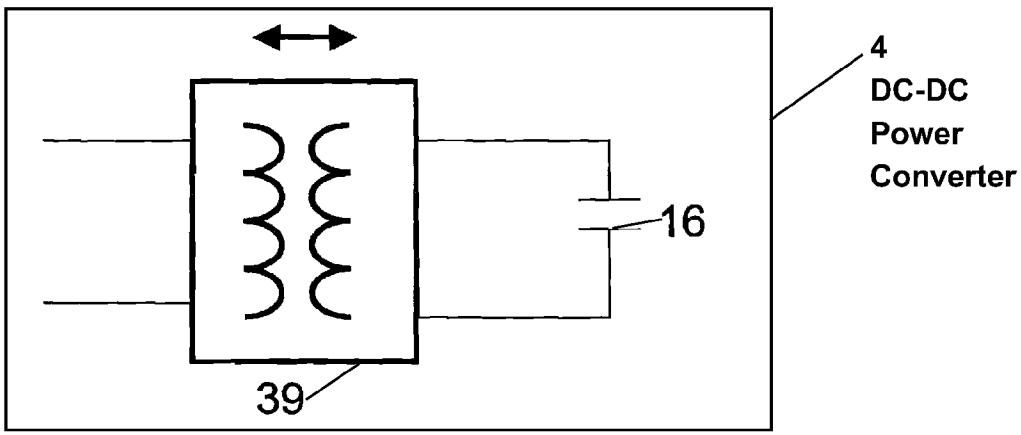
FIG. 4B is a schematic diagram of a single sided, bidirectional transformer design of a circuitry component according to one embodiment of the invention.

Considering FIG. 5C it may be appreciated that the design of FIG. 3A can be considered as merely a fold over of the design of FIG. 5C where the right side is folded over onto the left so that the input and the output are coincident and the output can be considered a coincident circuit output connection (38). Naturally the input and output may be at the same or different voltages. The resultant voltage or output voltage may be substantially similar to the average sourced DC voltage or the average DC supply voltage. It may also be different from the average DC supply voltage. As shown in FIGS. 4A and B, there may be included one or more voltage transformers (39) to transform a voltage. These may serve to isolate or may change voltage levels. In addition, the interim signal circuitry (28) that achieves a large voltage variation perhaps as a large voltage variation interim signal circuitry (29), may itself be or include a voltage transformer as shown in the example in FIG. 2. For switchmode operation, the voltage transformer (39) may even be a switch-mode isolated power converter (50), isolated switch-mode converter, a high frequency switch-mode power converter, or even any combinations of these as well as other components. As illustrated in FIG. 4B, the voltage transformer (39) may be bidirectional to achieve the one sided effect and coincident circuit output connection (38) as discussed above.

Figure 6:
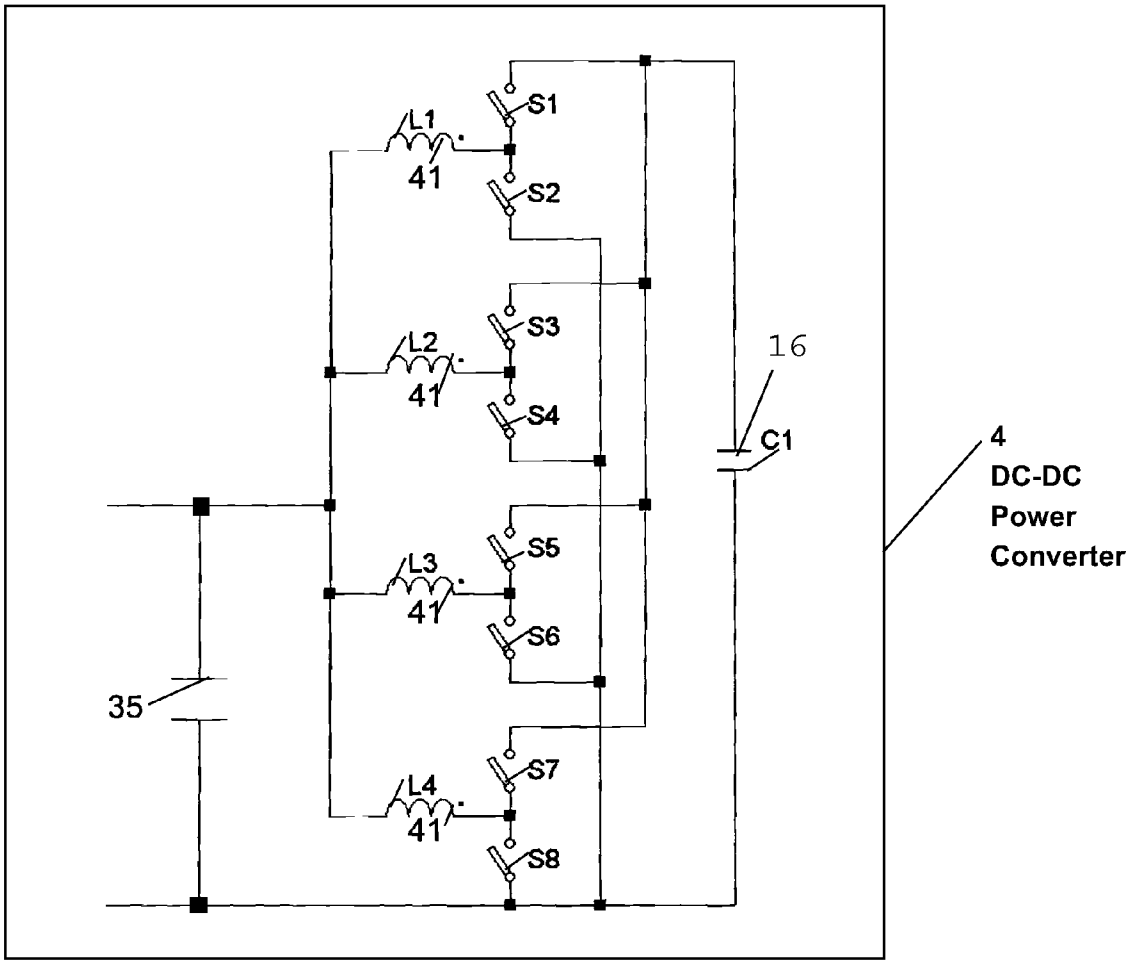
FIG. 6 is a schematic diagram of a four phase design switched design of a circuitry component according to one embodiment of the invention.
Figure 7:
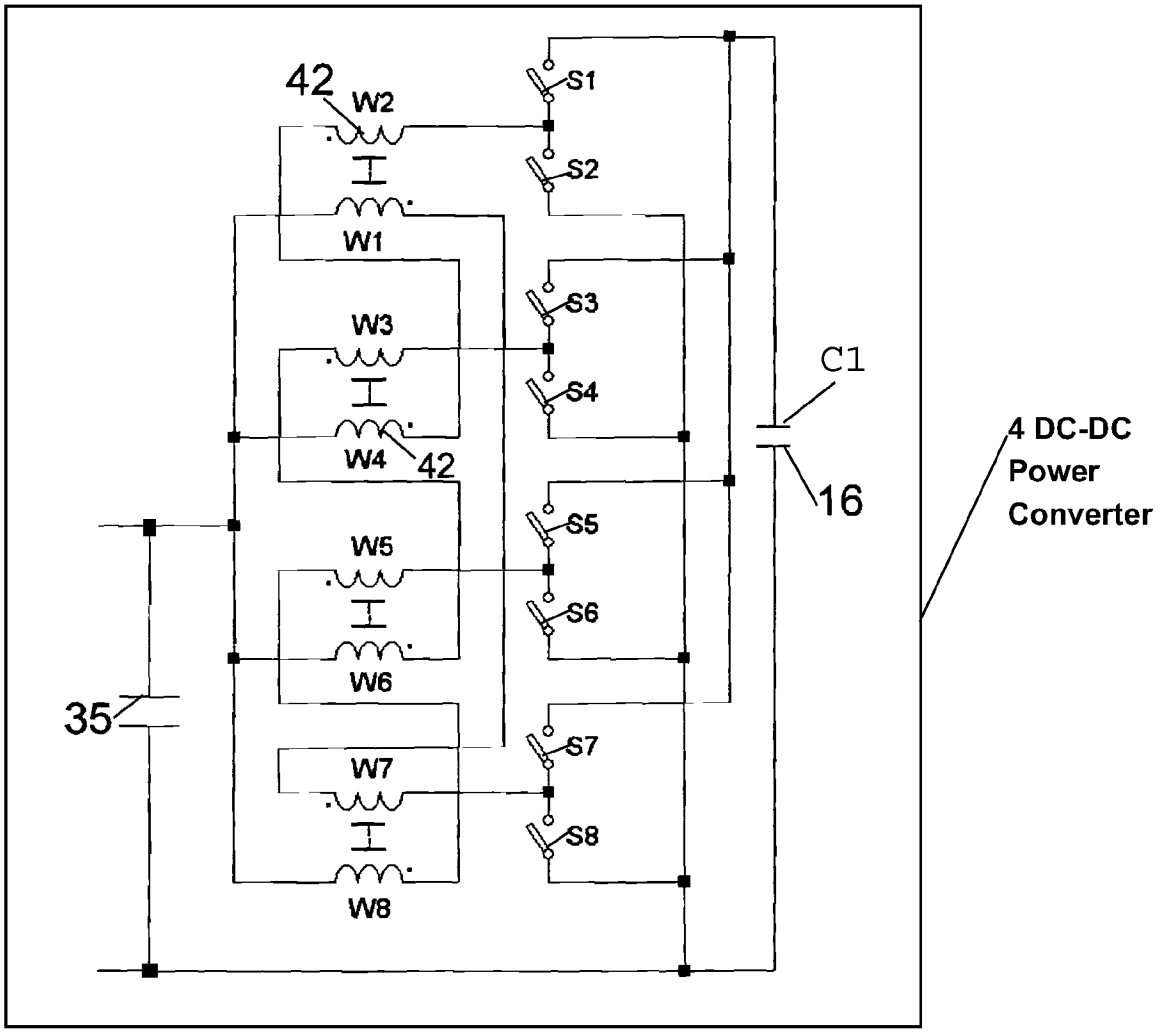
FIG. 7 is a schematic diagram of a four phase, coupled inductor design of a circuitry component according to one embodiment of the invention.
Figure 8:
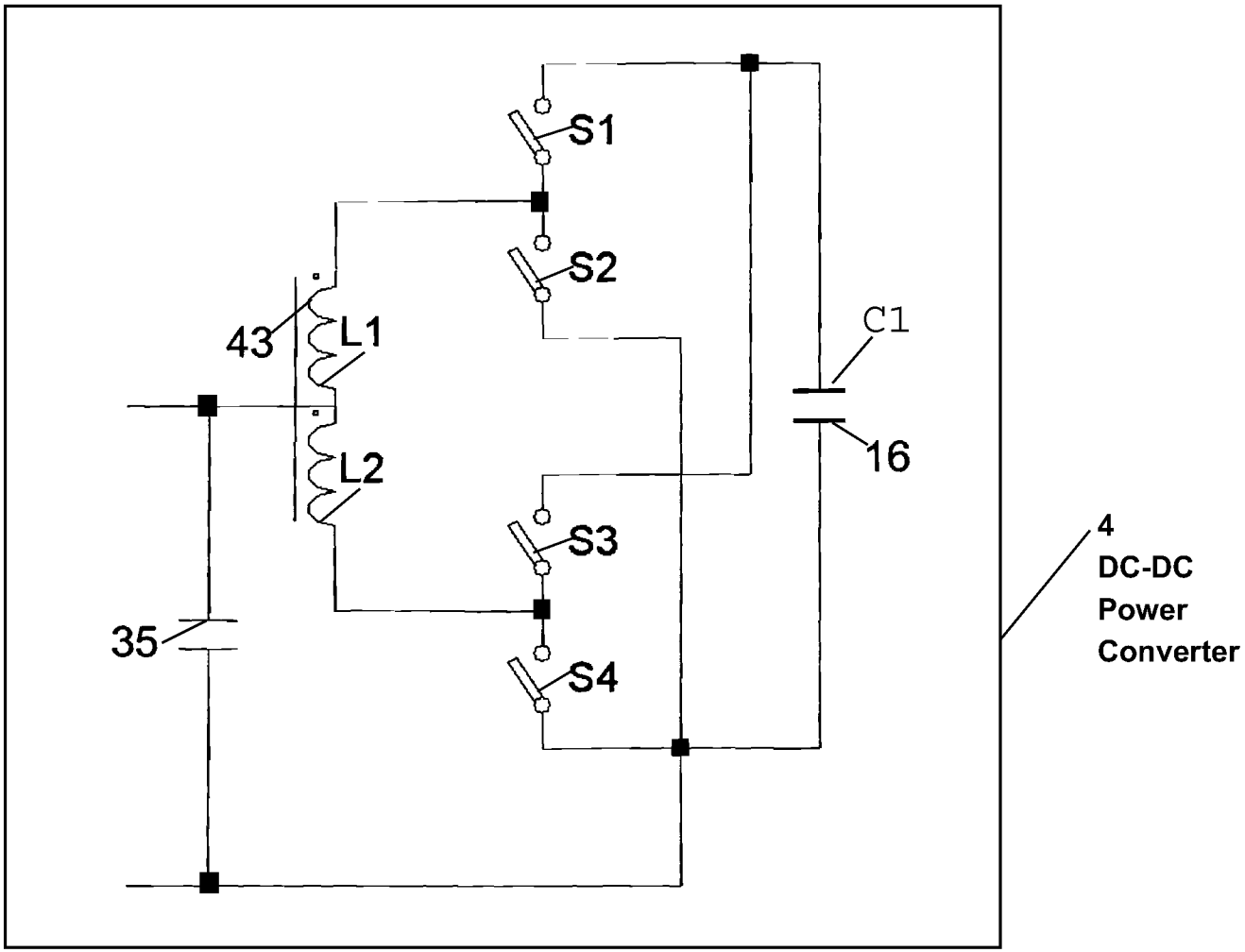
FIG. 8 is a schematic diagram of a two phase, tapped and coupled inductor design of a circuitry component according to one embodiment of the invention.

As shown in FIGS. 6, 7, and 8, embodiments may include a multiphase design to reduce ripple, minimize inductor sizes, or the like. FIG. 6 shows multiple phase inductors (41) in a simpler design. The multiple phase inductors (41) can be switched to operate a differing times and to sequence through operation. This can be accomplished by individual inductor switch circuitry with individual phase switching. In this manner the embodiment can achieve multiple phase inductively affecting the operation. In the circuit of FIG. 6 it can be seen that the same basic implementation can be achieved using a multiphase converter. This may allow smaller ripple at the switching frequency or the use of smaller inductors.

FIG. 7 shows an embodiment in which the inductive elements (19) are configured as interphase connected inductors (42). As can be seen, other inductive elements can be magnetically coupled to form a transformer type of arrangement. By including inductively coupled multiple phase inductor elements as shown, the designs can be configured to achieve the advantages and to utilize affects such as described in U.S. Pat. No. 6,545,450, hereby incorporated by reference. In FIG. 7 there is a multiphase converter circuit of the invention where coupled inductors are used to further minimize the size of the inductors and the voltage ripple on the output.

As shown in FIG. 8, a tapped inductor (43) can be use as well. As discussed in this reference, leakage inductance can be used to achieve the desired affect such as limiting the current on the switch components or the like. In instance where the leakage inductance is too small or not appropriate, separate inductors may be included as well to emulate the earlier inductive element (19). In FIG. 8 there is a two phase converter circuit of the invention. L1 and L2 are simply two windings on a common core or, a center tapped winding on a single core.

Figure 9:
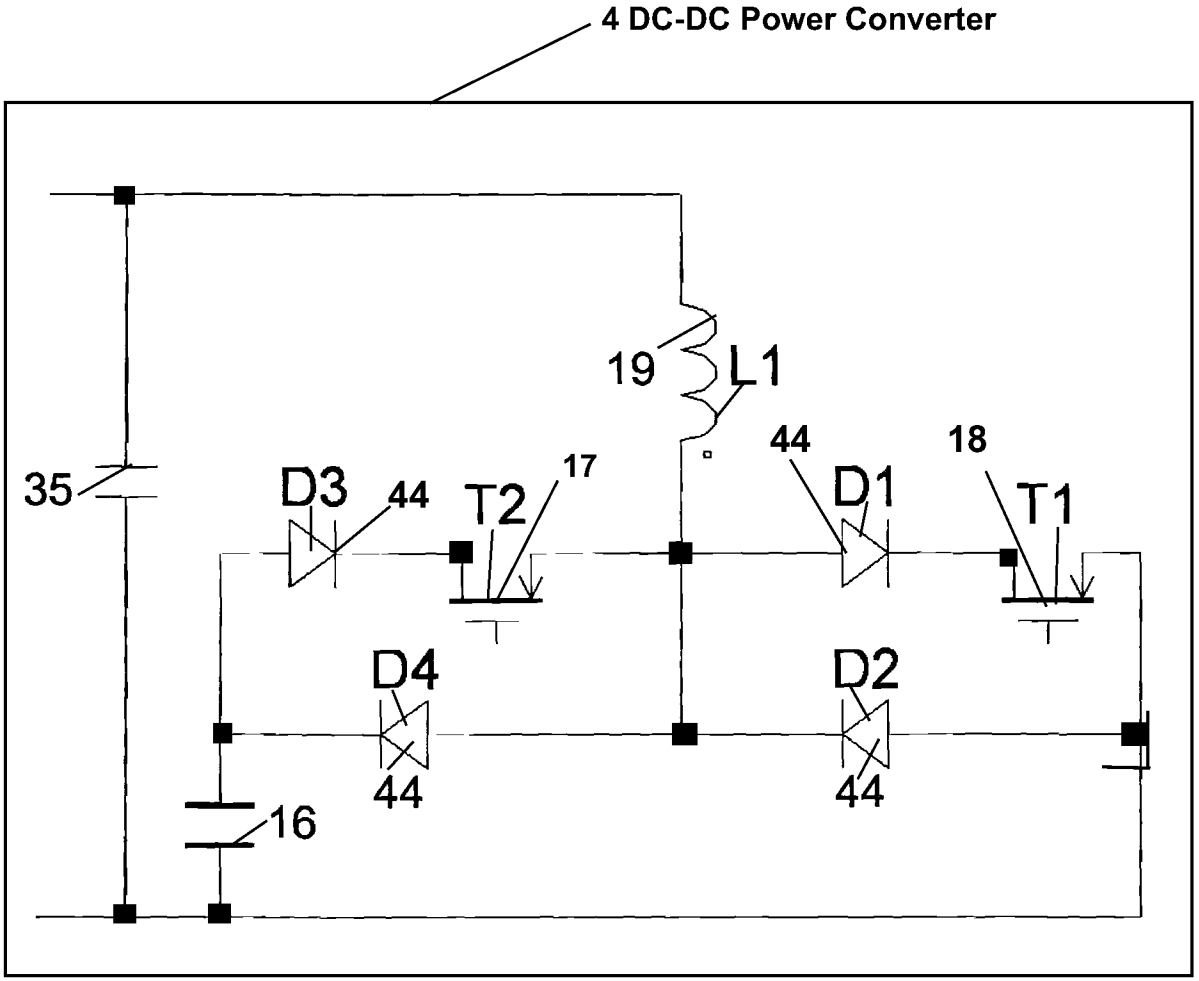
FIG. 9 is a schematic diagram of a diode design of a circuitry component according to one embodiment of the invention.

FIG. 9 illustrates but one example where intracircuitry path diodes (44) can be included. Such diodes can be configured as antiparallel diodes in specific circuitry paths as is well known. Switches can at times be replaced with diodes and the like as may be appreciated from the differing modes of operation. The circuit of FIG. 9 may be used if the switches are FETs. The series and anti-parallel diodes shown may be required as current is demanded to travel in either direction through the FET. This can be considered a function of the robustness of the FET.

Figure 10:
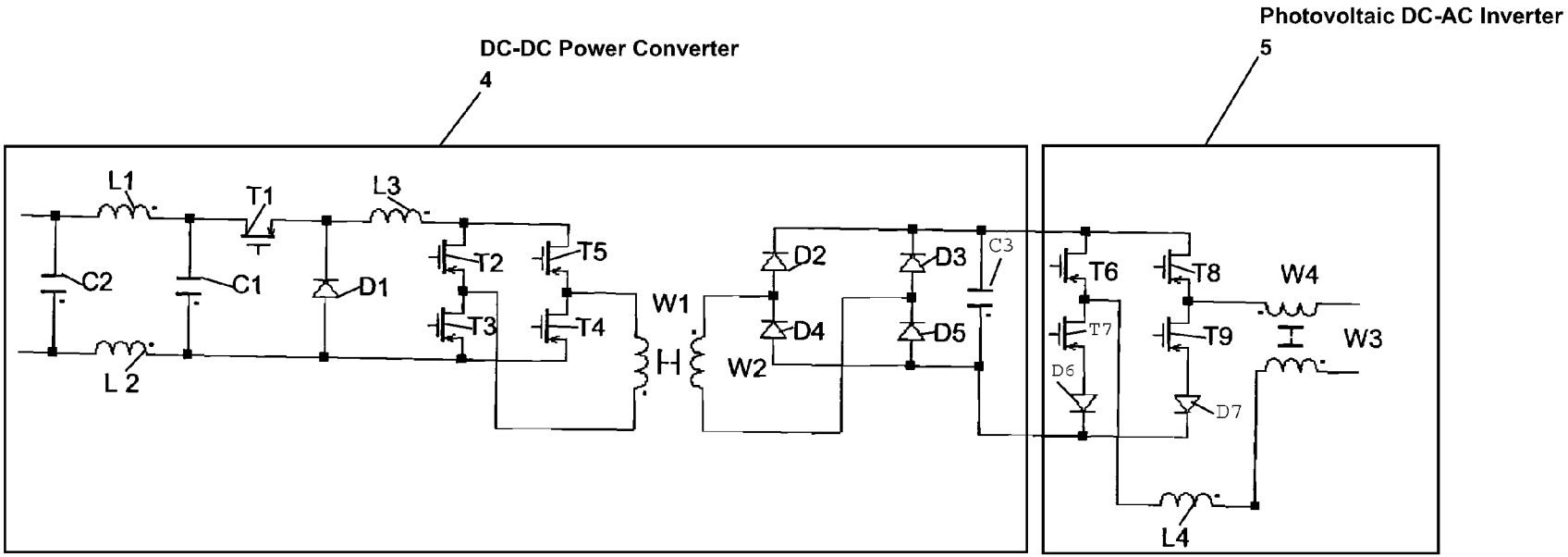
FIG. 10 is a schematic diagram of an enhanced solar power grid-tied design that may be altered according to embodiment of the present invention.

Returning to the solar power implementation shown schematically in FIG. 1, it can be understood how the invention can be implemented with other features. Solar power optimization can be achieved with other improvements to photovoltaic converters that are described in U.S. Application No. 60/982,053, U.S. Application No. 60/986,979, PCT Application No. PCT/US08/57105, PCT Application No. PCT/US08/60345, and PCT Application PCT/US08/70506 to the present inventors and assignee. Although these aspects are independent of and not necessary to the understanding of the present invention, each can be combined with the present invention and so the listed applications and/or publications are hereby incorporated by reference. As can be appreciated from an understanding of the features shown in FIGS. 1 and 5C, it can be appreciated how a substantially power isomorphic photovoltaic DC-DC power converter (45) can be included with its switch operation altered to include the teachings of the present invention. Similarly, a maximum power point converter (46) can be included and the present invention can be achieved with appropriate switch control. As described above, an embodiment of the invention may start with the same simplified schematic such as shown in FIG. 10 and may use a film capacitor for energy storage by replacing a with a film capacitor capable of handling a 400 to 600 volt change during a cycle at full power. Capacitor optimized circuit design and/or circuit alteration can be accomplished by:

A. Increasing the voltage rating of T6-T9 and D6, 7. This might lower the efficiency but may allow the desired use of a film capacitor.

B. Increasing the voltage rating of D2-D5. This may also lower efficiency.

C. Increasing the volt second capability of the isolation transformer.

D. Increasing the voltage capability of T2-T5. This may also lower efficiency.

E. Altering the input buck converter (T1, D1 and L3) relative to the MPP range. As the existing circuit only can lower the input voltage, a higher MPP voltage may be required. Alternatively, a boost circuit may be substituted. Higher voltage devices may be used as well.

F. Adapting the control circuit to allow the voltage to change on C3 without affecting the overall transfer function.

As can be seen this may be a perhaps radical departure from some conventional designs. It may, however, result in a long life inverter.

If one begins with the condition that the energy storage capacitor operates with high voltage swings, other topologies or compromises may be more suitable. In some embodiments, it may be possible that isolation could be eliminated entirely. Isolation may be evaluated in the designs of some embodiments from perspectives that recognize the various reasons for it (including regulatory and safety requirements.) However, with a system that involves variable voltage as established in some embodiments of the invention, a designer may opt to not include isolation.

Figure 11:
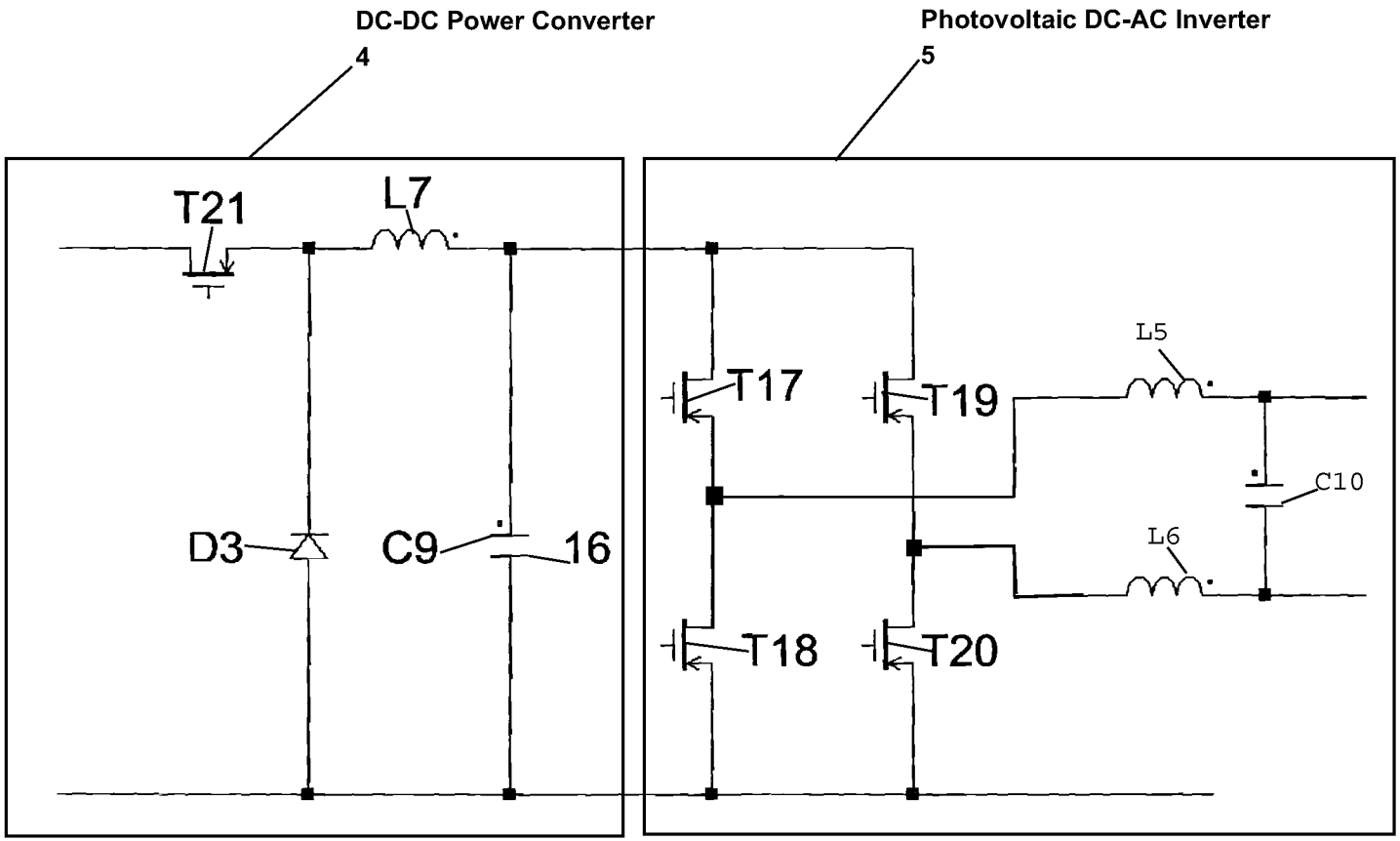
FIG. 11 is a schematic diagram of another enhanced solar power design.

The circuit of FIG. 11 may be an example of another embodiment. While the schematic appears similar to conventional use, substantially differing functions may be involved. To begin, as above, the energy storage element C9 may be a film capacitor (or other non-electrolytic capacitor). The circuit may also be designed to accommodate or cause a large voltage swing on C9. For example, embodiments may be designed to operate over a voltage range of 400 to 550 volts. (It is clear with this invention that much larger voltage swings provide greater energy utilization for the capacitor and may be used.) The power conversion stages may also have new functions. In a typical grid-tied converter the input stage may be dedicated to the function of operation at a Maximum Power Point (MPP). In designs according to the present invention, however, the output voltage of the input stage may be variable. This may add another function to the input stage. The input stage (perhaps such as a buck converter consisting of T21, D3 and L7) may have a control function which seeks MPP and operates with the MPP applied to the input. While this MPP circuit may receive constant power from the solar panels, its output voltage may be varying from 400 volts to 550 volts at 100 or 120 Hz. The output stage (perhaps such as a grid driver consisting of T17-T20 plus an output filter) may provide AC power to the grid in a manner that provides power from a variable source. The voltage on C9 with this topology may also be configured to never drop below the voltage on the power grid. With variable voltage on C9, the power semiconductor switches may be rated for higher voltage, for example 600 volts. In embodiments, the voltage on C9 might also never exceed the breakdown voltage on the semiconductor switches.

In embodiments, the output stage may also have another function. It may regulate the voltage on C9 to stay within the designed voltage range (perhaps such as 400 to 550 volts) by pulling power from the capacitor and supplying the grid. This may occur while the input stage is supplying steady power at MPP for the solar panels. There may also be protection circuits. If the output stage for example cannot pull enough power from C9 to keep its voltage below 550 volts, the input stage may be configured to limit the input power. This could occur if the grid had to be disconnected for example.

The circuit of FIG. 5C also has potential widespread use in any electronics application where it may be desirable to have such a long life component. The circuit of FIG. 5C may even be viewed as a capacitance multiplier. Alternatively, it may also be viewed as a ripple reducer. Such an embodiment of a circuit can be thought of as a universal replacement for an electrolytic capacitor. The input voltage and output voltage can additionally be set at differing values as needed. This circuit also has the potential of being bidirectional. That is, with the right control algorithm, the energy may flow from input to output or from output to input. In addition, the buck and boost stages may be interchanged. It is also possible to use a buck converter for both the input stage and the output stage. It may also be possible to use a boost converter for both the input and output stages. This may involve considering the voltage ranges possible from such configurations.

As another example, consider a more detailed example where an electrolytic capacitor is used in a PFC or a solar inverter circuit for the cycle by cycle voltage smoothing and energy storage. For this example consider the use of a 390 microfarad electrolytic capacitor operating at 400 VDC minimum nominal and having 1.4 amperes RMS ripple current flowing through it at a frequency of 120 Hz. The resultant voltage ripple would be 4.68 volts RMS or a peak to peak ripple of 13.4 volts. For simple comparison the minimum voltage of 400 volts is maintained. The voltage swing on this capacitor then swings from 400 volts to 413.4 volts. The energy stored at 413.4 volts is 33.325 joules. The energy stored at 400 volts is 31.2 joules. So during one half cycle the electrolytic capacitor stores an additional 2.125 joules. Now to compare the circuit of invention, a 20 uF film capacitor with a voltage rating of 800 volts will be used. As mentioned earlier the energy stored in L1 is small. This means all the cycle by cycle energy must now be stored in the film cap. At 400 volts the 20 uF capacitor stores 1.6 joules. Adding 2.125 joules gives 3.727 joules which the film cap must store at peak voltage. Solving for v gives 610 volts. So for this example the voltage on the film capacitor swings from 400 volts to 610 volts cycle by cycle. The same energy is stored. It may be noted by some that while if the current through the electrolytic capacitor is sinusoidal the voltage swing is also substantially sinusoidal. But the voltage on the film capacitor is not. This buck or boost action of the switching power conversion must preserve the energy storage. As energy storage changes with voltage squared on a capacitor, the resultant transfer function must be nonlinear. The resultant voltage waveform on the film capacitor is more egg-shaped or rounded on the top.

The control circuitry and transistor driver circuitry for this invention are widely known methods to achieve the described functions. The invention is embodied in the fundamental power conversion aspects and the concomitant value of replacing an electrolytic capacitor with a non-electrolytic. The object of the control circuit is to preserve low voltage on the connection where the electrolytic capacitor would be. Also not mentioned is a small bypass capacitor which may also be necessary to minimize high frequency ripple. While it may be an object to completely eliminate the ripple at this junction, it is possible to emulate another aspect of the electrolytic capacitor—that is, having a small ripple at the 120 Hz frequency. This is easily achieved with the control circuit, perhaps even as simply as by reducing the gain of a control loop.

As can be easily understood from the foregoing, the basic concepts of the present invention may be embodied in a variety of ways. It involves both solar power generation techniques as well as devices to accomplish the appropriate power generation. In this application, the power generation techniques are disclosed as part of the results shown to be achieved by the various circuits and devices described and as steps which are inherent to utilization. They are simply the natural result of utilizing the devices and circuits as intended and described. In addition, while some circuits are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the devices and circuits described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "converter" should be understood to encompass disclosure of the act of "converting"—whether explicitly discussed or not—and, conversely, were there effectively disclosure of the act of "converting", such a disclosure should be understood to encompass disclosure of a "converter" and even a "means for converting" Such changes and alternative terms are to be understood to be explicitly included in the description.

Any patents, publications, or other references mentioned in this application for patent or its list of references are hereby incorporated by reference. Any priority case(s) claimed at any time by this or any subsequent application are hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the List of References other information statement filed with or included in the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i)

each of the power control devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein. In addition and as to computerized aspects and each aspect amenable to programming or other programmable electronic automation, the applicant(s) should be understood to have support to claim and make a statement of invention to at least: xiv) processes performed with the aid of or on a computer as described throughout the above discussion, xv) a programmable apparatus as described throughout the above discussion, xvi) a computer readable memory encoded with data to direct a computer comprising means or elements which function as described throughout the above discussion, xvii) a computer configured as herein disclosed and described, xviii) individual or combined subroutines and programs as herein disclosed and described, xix) the related methods disclosed and described, xx) similar, equivalent, and even implicit variations of each of these systems and methods, xxi) those alternative designs which accomplish each of the functions shown as are disclosed and described, xxii) those alternative designs and methods which accomplish each of the functions shown as are implicit to accomplish that which is disclosed and described, xxiii) each feature, component, and step shown as separate and independent inventions, and xxiv) the various combinations and permutations of each of the above.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. Both the examiner and any person otherwise interested in existing or later potential coverage, or considering if there has at any time been any possibility of an indication of disclaimer or surrender of potential coverage, should be aware that in the absence of explicit statements, no such surrender or disclaimer is intended or should be considered as existing in this or any subsequent application. Limitations such as arose in *Hakim* v. *Cannon Avent Group, PLC,* 479 F.3d 1313 (Fed. Cir 2007), or the like are expressly not intended in this or any subsequent related matter.

In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. An enhanced component power system comprising:

at least one DC energy source providing a DC input that has two DC power lines;

a parallel inductive element connected across said two DC power lines as part of a path;

alternative switch circuitry connected to said parallel inductive element that establishes a first alternative circuitry path across said DC power lines through said parallel inductive element and a second alternative circuitry path across said DC power lines through said parallel inductive element;

a capacitor path responsive to said alternative switch circuitry in said first alternative circuitry path;

an alternative circuitry path also responsive to said alternative switch circuitry in said second alternative circuitry path; and a smoothed DC power output connected to said capacitor path in said first alternative circuitry path and said second alternative circuitry path.

2. An enhanced component power system as described in claim 1 and further comprising a substantially power isomorphic photovoltaic DC-DC power converter.

3. An enhanced component power system as described in claim 1 wherein said alternative switch circuitry comprises:

a first switch element connected to said parallel inductive element; and a second switch element connected to said parallel inductive element and across said capacitor path.

4. An enhanced component power system as described in claim 1 wherein said DC input has an alternating current component superimposed on a DC signal, and further comprising a low ripple controller to which said alternative switch circuitry is responsive.

5. An enhanced component power system as described in claim 4 wherein said capacitor path operatively stores a maximum operative capacitor energy, wherein said parallel inductive element operatively stores a maximum operative inductor energy, and wherein said maximum operative capacitor energy is substantially greater than said maximum operative inductor energy.

6. An enhanced component power system as described in claim 5 wherein said maximum operative capacitor energy and said maximum operative inductor energy are selected from a group consisting of:

a maximum operative capacitor energy that is at least about two times as big as said maximum operative inductor energy;

a maximum operative capacitor energy that is at least about five times as big as said maximum operative inductor energy; and a maximum operative capacitor energy that is at least about ten times as big as said maximum operative inductor energy.

7. An enhanced component power system as described in claim 5 wherein said capacitor path has a capacitor size selected from a group consisting of:

a 5 μF capacitor;

a 10 μF capacitor;

a 50 μF capacitor;

a 100 μF capacitor;

a 500 μF capacitor;

a capacitor sized at less than about one hundredth of an equivalent electrolytic circuit capacitance;

a capacitor sized at less than about one fiftieth of an electrolytic circuit capacitance;

a capacitor sized at less than about one twentieth of an equivalent electrolytic circuit capacitance; and a capacitor sized at less than about one tenth of an equivalent electrolytic circuit capacitance.

8. An enhanced component power system as described in claim 1 and further comprising a boost controller.

9. An enhanced component power system as described in claim 8 and further comprising a buck controller.

10. An enhanced component power system as described in claim 1 and further comprising large voltage variation interim signal circuitry.

11. An enhanced component power system as described in claim 10 wherein said large voltage variation interim signal circuitry is selected from a group consisting of:

at least about twenty times voltage variation signal creation circuitry;

at least about ten times voltage variation signal creation circuitry;

at least about five times voltage variation signal creation circuitry; and at least about double voltage variation signal creation circuitry.

12. An enhanced component power system as described in claim 10 wherein said large voltage variation interim signal circuitry comprises a voltage transformer.

13. An enhanced component power system as described in claim 12 wherein said voltage transformer comprises a switch-mode isolated power converter.

14. An enhanced component power system as described in claim 1 and further comprising a full circuit component bypass capacitor.

15. An enhanced component power system as described in claim 14 wherein said full circuit component bypass capacitor comprises a relatively small bypass capacitor.

16. An enhanced component power system as described in claim 15 wherein said relatively small bypass capacitor comprises a high frequency operative energy storage bypass capacitor.

17. An enhanced component power system as described in claim 16 wherein said high frequency operative energy storage bypass capacitor comprises a greater than high frequency cycle-by-cycle energy storage bypass capacitor.

18. An enhanced component power system as described in claim 1 and further comprising a high frequency switch controller selected from a group consisting of:

an at least about one thousand times a predominant ripple frequency switch controller;

an at least about five hundred times a predominant ripple frequency switch controller; and an at least about one hundred times a predominant ripple frequency switch controller.

19. An enhanced component power system as described in claim 1 and further comprising at least one antiparallel diode.

20. A device with power factor correction having enhanced life comprising:

operationally active power circuitry for said device and having at least one internal, substantially DC device voltage in two DC power lines;

an inductive element connected to one of said DC power lines;

alternative switch circuitry connected to said inductive element;

a capacitor path responsive to said alternative switch circuitry;

an alternative circuitry path also responsive to said alternative switch circuitry;

a power factor controller to which said operationally active power circuitry for said device is responsive;

a low ripple controller to which said alternative switch circuitry is responsive; and an internal low ripple DC voltage connected to said capacitor path and said alternative circuitry path and responsive to said low ripple controller.

21. A device with enhanced life power factor correction as described in claim 20 wherein said capacitor path operatively stores a maximum operative capacitor energy, wherein said inductive element operatively stores a maximum operative inductor energy, and wherein said maximum operative capacitor energy is substantially greater than said maximum operative inductor energy.

22. A device with enhanced life power factor correction as described in claim 21 wherein said maximum operative capacitor energy and said maximum operative inductor energy are selected from a group consisting of:

a maximum operative capacitor energy that is at least about two times as big as said maximum operative inductor energy;

a maximum operative capacitor energy that is at least about five times as big as said maximum operative inductor energy; and a maximum operative capacitor energy that is at least about ten times as big as said maximum operative inductor energy.

23. A device with enhanced life power factor correction as described in claim 20 wherein said low ripple controller comprises a switch frequency controller.

24. A device with enhanced life power factor correction as described in claim 23 wherein said switch frequency controller comprises a switch frequency controller high frequency switch controller.

25. A device with enhanced life power factor correction as described in claim 20 wherein said low ripple controller comprises a boost controller.

26. A device with enhanced life power factor correction as described in claim 25 and further comprising a buck controller.

27. A device with enhanced life power factor correction as described in claim 20 wherein said alternative circuitry path comprises a substantially energy storage free circuitry path.

28. A device with enhanced life power factor correction as described in claim 20 and further comprising a feedback sensor to which said low ripple controller is responsive.

29. A device with enhanced life power factor correction as described in claim 28 wherein said feedback sensor comprises an output voltage feedback sensor.

30. A device with enhanced life power factor correction as described in claim 20 wherein said low ripple controller comprises a switch duty cycle controller.

31. A device with enhanced life power factor correction as described in claim 30 wherein said switch duty cycle controller comprises an output voltage duty cycle controller.

* * * * *